US006050673A

United States Patent [19]

Wada et al.

[11] Patent Number: 6,050,673

[45] **Date of Patent: *Apr. 18, 2000**

[54] RECORDING APPARATUS WITH CONTROL OF CARRIAGE DRIVING MOTOR

[75] Inventors: Toshihide Wada; Tetsuyo Ohashi, both of Yokohama; Toshihiko Bekki, Kawasaki, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/812,667

[22] Filed: Mar. 10, 1997

Related U.S. Application Data

[63] Continuation of application No. 08/179,192, Jan. 10, 1994, abandoned.

[30] Foreign Application Priority Data

| | | | |
|---|---|---|---|
| Jan. 13, 1993 | [JP] | Japan | 5-004210 |
| Jan. 13, 1993 | [JP] | Japan | 5-004213 |
| Jan. 19, 1993 | [JP] | Japan | 5-023236 |
| Jan. 19, 1993 | [JP] | Japan | 5-066349 |

[51] Int. Cl.[7] ..... B41J 23/00

[52] U.S. Cl. ..... 347/37; 347/104; 346/139 D

[58] Field of Search ..... 347/37, 104; 346/139 D; 400/284, 300, 306.1, 337; 318/2, 685, 696

[56] References Cited

U.S. PATENT DOCUMENTS

| | | | |
|---|---|---|---|
| 4,208,139 | 6/1980 | Fujimoto et al. | 400/126 |
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,535,344 | 8/1985 | Noda | 346/139 D |
| 4,558,333 | 12/1985 | Sugitani et al. . | |
| 4,608,577 | 8/1986 | Hori . | |
| 4,723,129 | 2/1988 | Endo et al. . | |
| 4,740,796 | 4/1988 | Endo et al. . | |
| 4,755,836 | 7/1988 | Ta et al. | 346/139 R |

FOREIGN PATENT DOCUMENTS

| | | |
|---|---|---|
| 0469536 | 2/1992 | European Pat. Off. . |
| 54-056847 | 5/1979 | Japan . |
| 59-123670 | 7/1984 | Japan . |
| 59-138461 | 8/1984 | Japan . |
| 60-071260 | 4/1985 | Japan . |
| 62090280 | 4/1987 | Japan . |
| 4187477 | 7/1992 | Japan . |

*Primary Examiner*—John Barlow
*Assistant Examiner*—Craig A. Hallacher
*Attorney, Agent, or Firm*—Fitzpatrick, Cella, Harper & Scinto

[57] ABSTRACT

A recording apparatus for recording on a recording medium by use of a recording mechanism which travels along the recording medium comprises a carrier which enables the recording mechanism to travel along the recording medium, the carrier being capable of holding the recording mechanism detachably, and a carrier driving mechanism which enables the carrier to travel along the recording medium, the carrier driving mechanism prohibiting the movement of the carrier in an arbitrary position in the traveling area of the carrier. In this way, when the recording mechanism is attached to or detached from the carrier, the movement of the carrier is prohibited, thus making it possible to fix the carrier without any particular mechanism to suspend the movement of the carrier for a reliable and sound attachment or detachment of the recording mechanism to or from the carrier, and at the same time, to implement the miniaturization and lower cost of the apparatus.

35 Claims, 16 Drawing Sheets

RECORDING APPARATUS WITH CONTROL OF CARRIAGE DRIVING MOTOR

This application is a continuation of application Ser. No. 08/179,192 filed Jan. 10, 1994, now abandoned.

BACKGROUND OF THE INVENTION

1. Field of the Invention

The present invention relates to a recording apparatus. More particularly, the invention relates to a recording apparatus having a carrier capable of holding a recording mechanism detachably.

2. Related Background Art

To replace recording heads, ink cassettes, or the like in a conventional recording apparatus, a mechanism is provided to fix the carrier from the outside so that the carrier is not allowed to move. The fixation is made by coupling a hook member and others with the carrier.

Because of this fixation, the structure of an apparatus becomes inevitably complicated, thus leading to a larger size of the apparatus eventually.

Also, even in a case of the ink jet recording apparat us, on which the demand is on the increase in recent years in place of the wire-dot recording apparatus and the thermal transfer recording apparatus because of its higher recording speed, lesser noises of recording, a lower running cost, and the ease with which to miniaturize the apparatus, among other advantages, the same type of problem as above is encountered when replacing an ink jet recording head, an ink cartridge, or a head cartridge in which an ink jet recording head and an ink tank are integrally arranged.

Furthermore, in an ink jet recording apparatus, the ink discharging port surface of the ink jet recording head is capped with a capping member at the home position. However, there is a possibility that the ink discharging ports and others are damaged because the ink discharging port surface and the capping member to cap this surface are rubbed when the head and others are replaced.

SUMMARY OF THE INVENTION

The present invention is designed to solve the above-mentioned problems encountered in the prior art. It is an object of the invention to provide a recording apparatus capable of prohibiting the shifting of the carrier without any particular arrangement of a carrier shift prohibiting mechanism, thus achieving the miniaturization and simplification of the recording apparatus.

It is another object of the present invention to provide a recording apparatus capable of preventing the recording mechanism from being damaged when replacing the recording mechanism which is held by the carrier.

It is still another object of the present invention to provide a recording apparatus comprising a carrier capable of holding a recording mechanism detachably, which travels along a recording medium, and a carrier driving mechanism to enable the aforesaid carrier to travel along the recording medium, which is arranged to prohibit the shifting of the carrier in an arbitrary position in the traveling area of the carrier.

It is a further object of the present invention to provide a method for replacing the recording mechanism for a recording apparatus, comprising the following steps of:

shifting a carrier to an arbitrary position in the traveling area of the carrier by use of a carrier driving mechanism which enables the carrier capable of detachably holding a recording mechanism to travel along a recording medium;

prohibiting the shifting of the aforesaid carrier by use of the aforesaid carrier mechanism subsequent to the execution of the aforesaid shifting step; and detaching the recording mechanism from the carrier.

DETAILED DESCRIPTION OF THE PREFERRED EMBODIMENTS

Hereinafter, with reference to the accompanying drawings, the description will be made of the embodiments according to the present invention.

Figure 1:
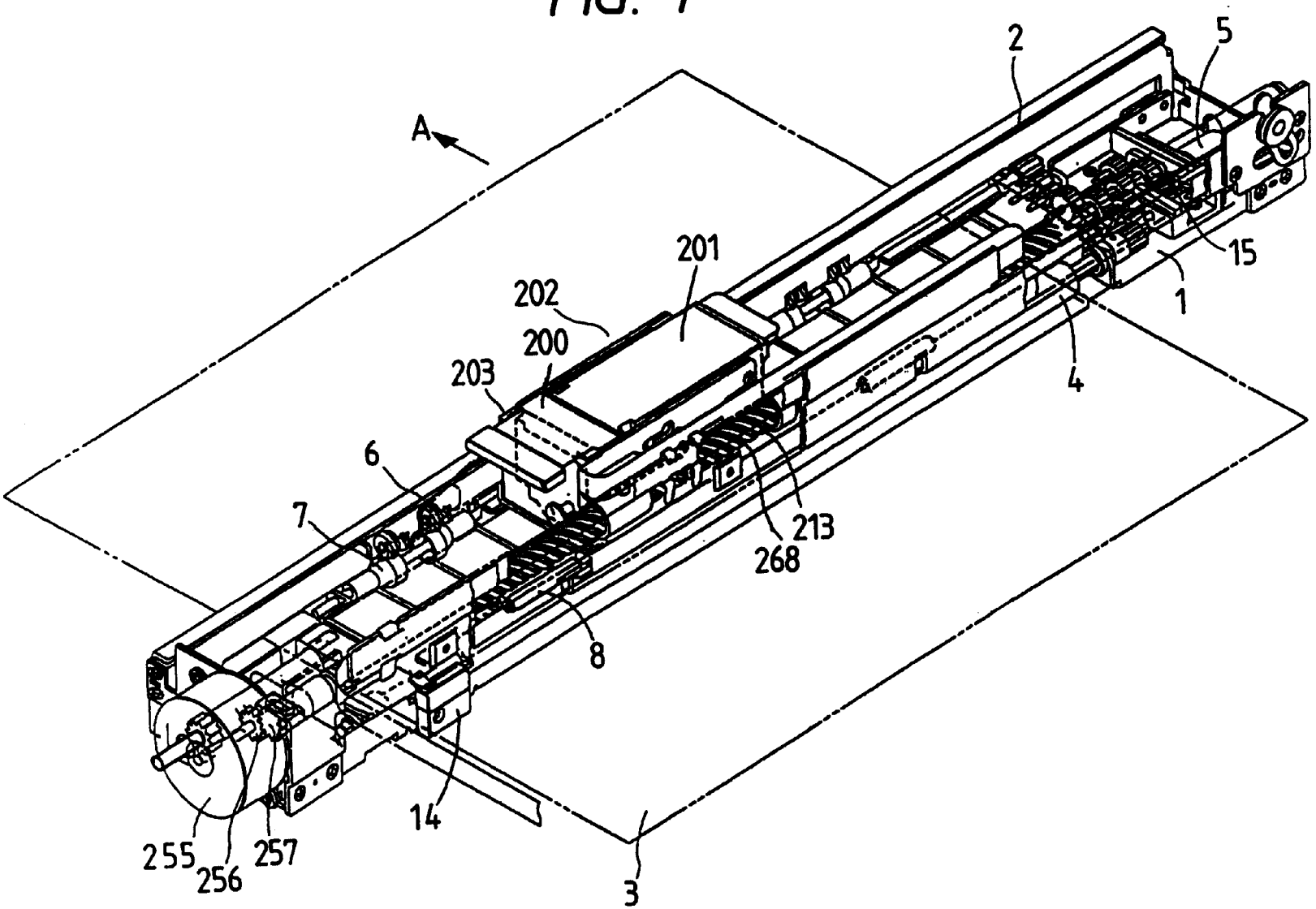
FIG. 1 is a perspective view schematically showing a first embodiment according to the present invention.

FIG. 1 is a perspective view showing a recording apparatus according to an embodiment of the present invention.

In FIG. 1, a head cartridge 202 to which a recording head 200 and an ink tank 201, constituting recording means, are coupled. The head cartridge is mounted on a carrier 203. One end of the carrier 203 on the recording head 200 side is slidably fitted to a lead screw 213 in its axial direction. The screw is rotatively fixed to a chassis 1. On the other end of the carrier, a guide is arranged. This guide is fitted into a guide rail 2 formed on the chassis 1 slidably in parallel to the axial direction of the lead screw 213. The carrier 203 is structured so that while its posture is being kept constantly at all times, the carrier can reciprocate along the rotation of the lead screw 213 in its axial direction.

In other words, a lead screw gear 257 fixed to the left-side end of the lead screw 213 and a pinion gear 256 fixed to the output shaft of a carrier motor 255 engage with each other. Further, a lead pin 209 (FIG. 7) mounted on the carrier 203 is fitted into a guide groove 268 (FIG. 6) which is formed spirally on the lead screw 213 at a given pitch. Therefore, when the lead screw 213 rotates along the regular and reverse rotations of the carrier motor 255, the carrier 203 reciprocates. The scanning executed by the carrier 203 will be described later in detail.

The flexible cable which transmits printing signals from an electric circuit to the recording head 200 is positioned and held by a flexible cable holder 16 on a pinch roller frame 11.

In synchronism with the reciprocation of the carrier 203, the recording head 200 is driven to discharge ink in accordance with the recording signals, thus executing a one-line recording on a recording medium 3. In other words, the recording head 200 is provided with fine liquid discharging ports (orifices), liquid passages, energy activation units arranged on parts of these liquid passages, and energy generating elements which generate the energy utilized for discharging liquid by activating the liquid in the aforesaid activation units.

As energy generating means which generates an energy of the kind, there are a recording method which uses piezoelectric elements and others; a recording method for discharging liquid by generating a heat with the irradiation of electromagnetic waves such as laser; or a recording method which uses energy generating means for discharging liquid by heating the liquid with the electrothermal transducers such as heat generating elements having heat generating resistors.

Of these methods, the recording head used for the ink jet recording method, which discharges ink by the application of thermal energy, makes it possible to arrange the liquid discharging ports in a high density to form droplets by discharging liquid for recording. As a result, recording can be made in a high resolution. Particularly, the recording head which uses the electrothermal transducers as energy generating means can be easily fabricated compactly. At the same time, the advantages of the IC technologies and micro processing techniques, which are remarkably advanced in the semiconductor field in recent years with the highly improved technique and reliability, can be utilized fully for the attainment of the highly densified assembly at a low cost of fabrication, among many other advantages that this type of recording head may demonstrate.

When a one-line recording is executed by the scanning of the aforesaid carrier 203, the recording material 3 is fed by feeding means for one-line portion for the next recording. This conveyance of the recording material 3 is executed by a pair of rotatable feed roller 4 and a pinch roller 8 which abuts on the feed roller under pressure, and by a pair of rotatable exhaust roller 7 and a spur 6 which abuts on the exhaust roller.

To describe this arrangement more specifically, the recording material, the recording surface of which faces the discharging port surface of the recording head 200 is in contact with the feed roller 4 under pressure by means of the pinch roller 8. Then, by rotating the feed roller 4 by an appropriate rotation of a feed motor 5, the recording material is conveyed to the recording position as required. After the recording, the recording material is pressed by the spur 6 to the exhaust roller 7. Thus, by the rotation of the exhaust roller 7, the recording material 3 is exhausted outside the apparatus.

The feed roller 4 and exhaust roller are driven by the feed motor 5, but the driving force is transmitted by a speed reducing gear train 15.

The position of the rotational shaft of the spur 6 which abuts on the recording surface of the recording material 3 is fixed, and whereas the contacting position of the spur 6 and recording material 3 does not change irrespective of the thickness of the recording material 3, the exhaust roller 7 is arranged to be deformed by the thickness of the recording material 3 in order to operate in accordance with the thickness of the recording material 3. In specific, the exhaust roller 7 is made of a thin rubber and is formed in a conical shape. The exhaust roller is thus deformed with a restorative force in the radial direction. In this way, its deformation is made corresponding to the pressure exerted by the spur 6 and the thickness of the recording material 3.

Also, it may be possible to obtain the same effect by structuring the exhaust roller 7 with a material having properties of a large resilient deformation, such as a porous sponge, a resin or rubber having an extremely low hardness.

Further, it may be possible to bias the exhaust roller 7 as a whole by a spring or the like to the spur 6.

As a result, the recording head 200 and recording material 3 can be kept with a given space irrespective of the thickness of the recording material 3, thus making a stabilized feeding possible.

Figure 2:
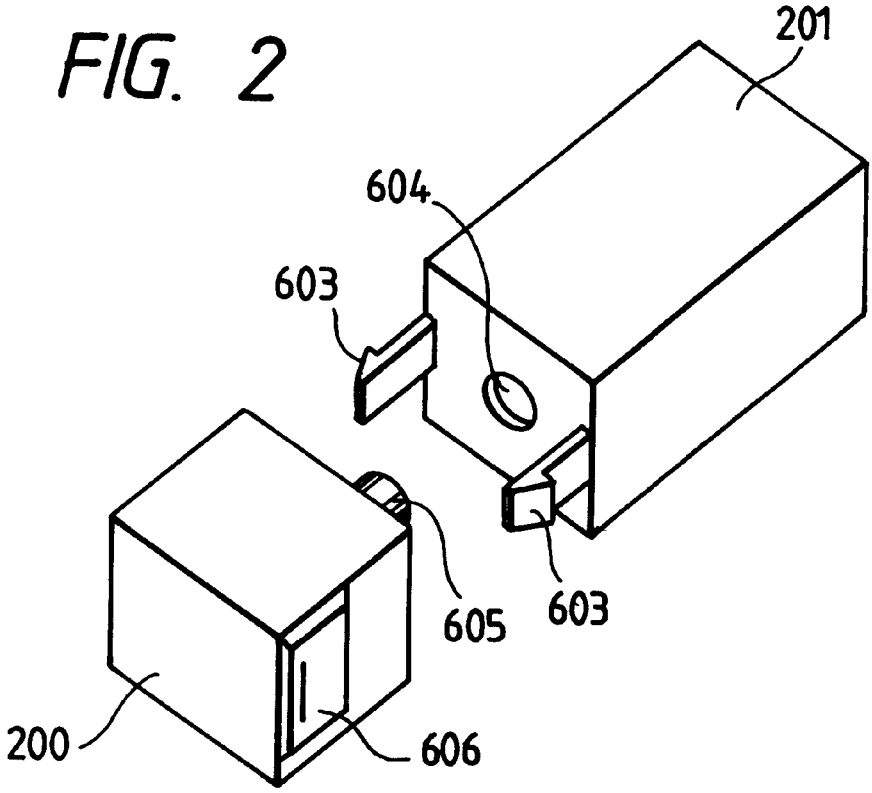
FIG. 2 is a view schematically showing a recording head of an ink tank separation type.

A reference numeral 14 designates a paper sensor which detects the presence and absence of the recording material 3; 603, a coupling member to couple the recording head 200 and an ink tank 201, which are detachably coupled with a coupling part (not shown) on the recording head side (FIG. 2); 604, an ink inlet on the ink tank side; 605, an ink supply inlet on the recording head side, which is coupled when the recording head 200 and ink tank 201 are joined; and 606, nozzles to discharge ink.

Figure 3:
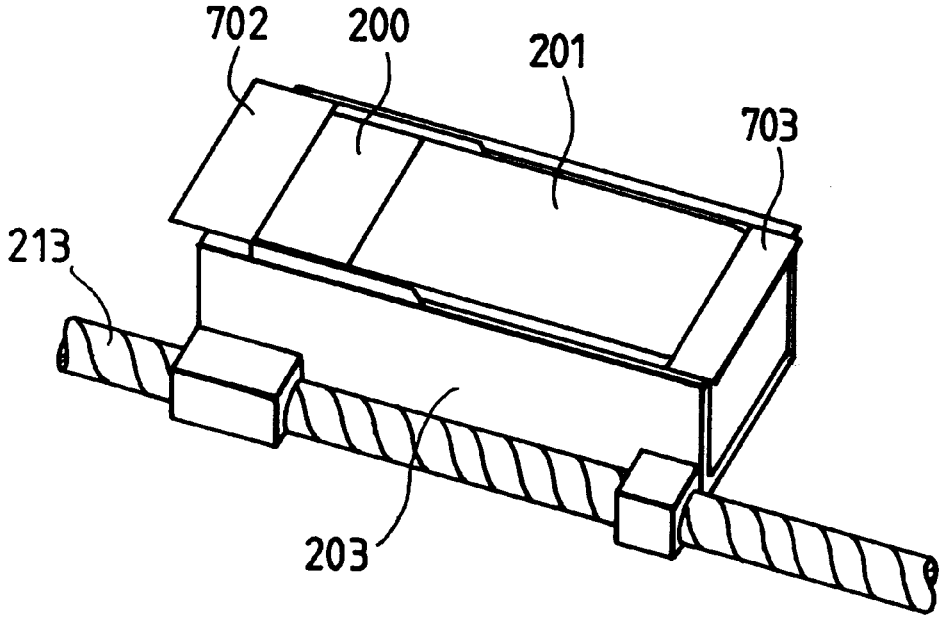
FIG. 3 is an enlarged view schematically showing a carriage.

FIG. 3 is an enlarged view showing the carrier, in which a reference numeral 203 designates the carrier main body; 702, a first lever; and 703, a second lever.

Figure 4A:
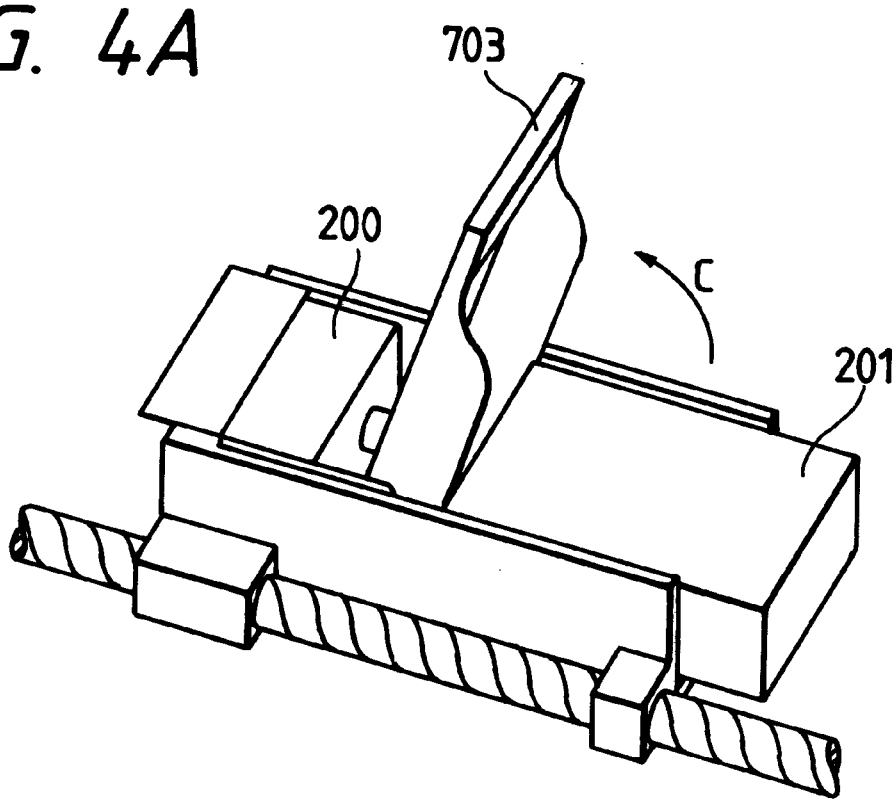
FIGS. 4A and 4B are views schematically showing the states that a recording head and an ink tank are detached or attached.
Figure 4B:
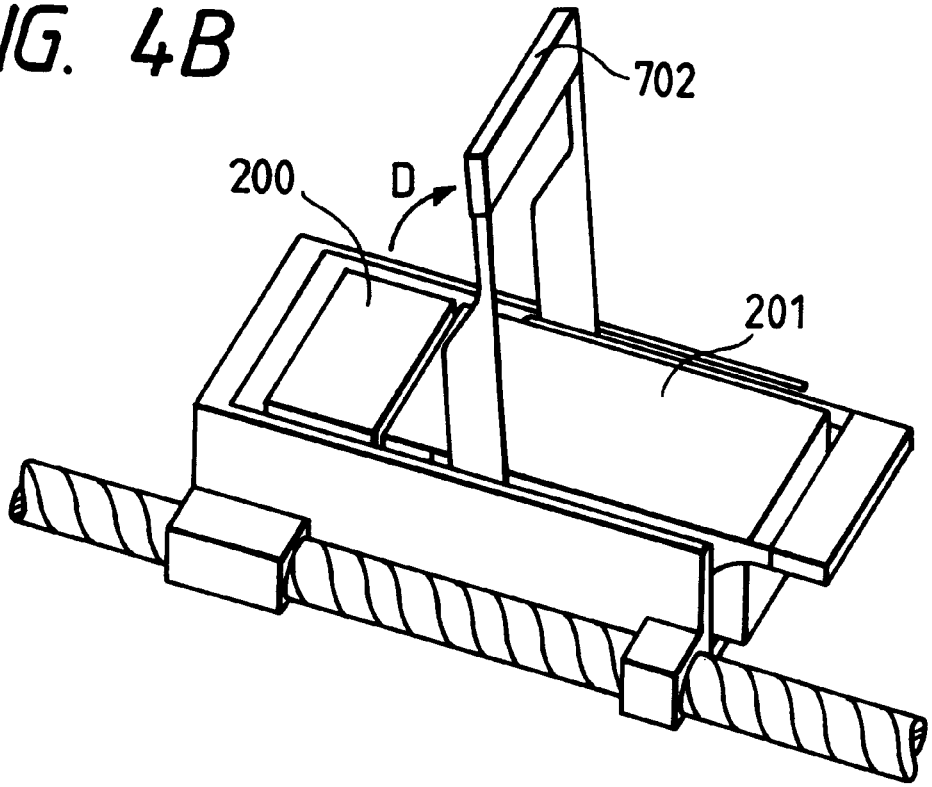

FIGS. 4A and 4B are views showing the operation of the attachment and detachment of the recording head and ink tank. When the lever 703 is operated to rotate it in the direction C in FIG. 4A, only the ink tank is detached. Also, the lever 702 is operated to rotate it in the direction D in FIG. 4B, both the recording head and ink tank can be removed in its integrated state.

Figure 5A:
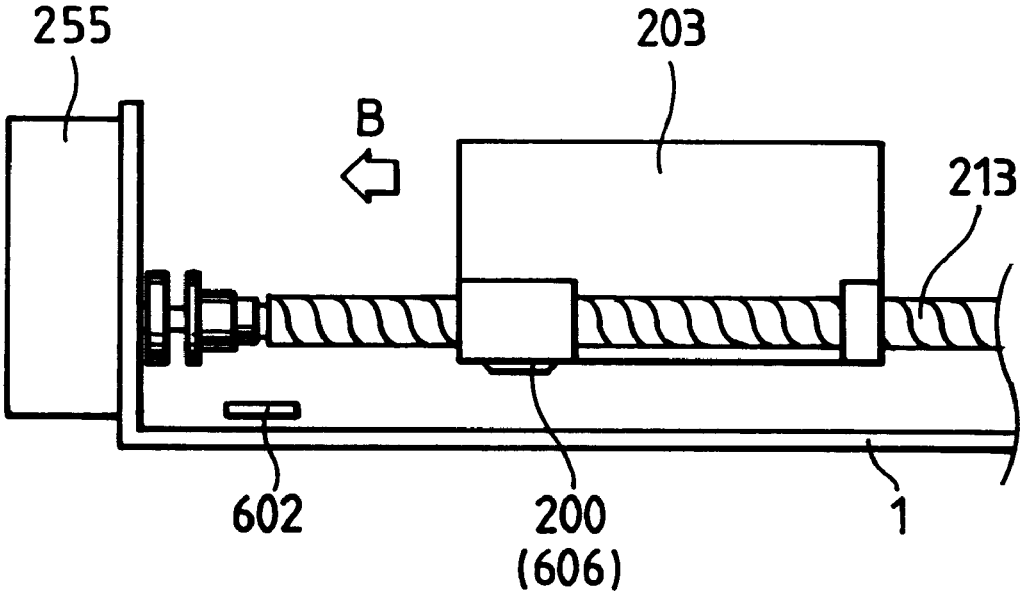
FIGS. 5A and 5B are views schematically illustrating the state that a recording head is being capped.
Figure 5B:
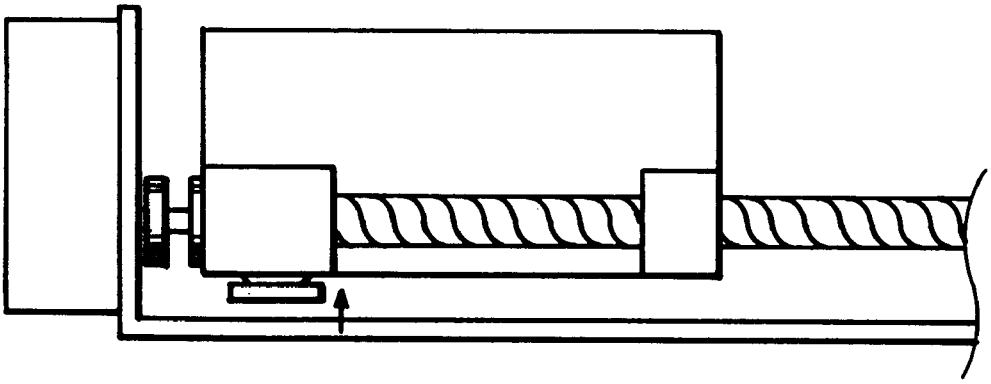

FIGS. 5A and 5B are views schematically showing the state that the discharging nozzles 606 of the recording head 200 are capped with a cap 602.

When the carrier 203 guided in the direction B by the rotation of the lead screw 213 arrives at the home position, the cap 602 is moved upward by means of a mechanism (not shown) to cap the discharging nozzles 606 which are exposed to the bottom face of the carrier 203. In this way, it is possible to prevent ink in the discharging nozzles from being dried, and at the same time, prevent the discharging nozzles from being clogged by dust particles in the atmosphere.

Figure 6:
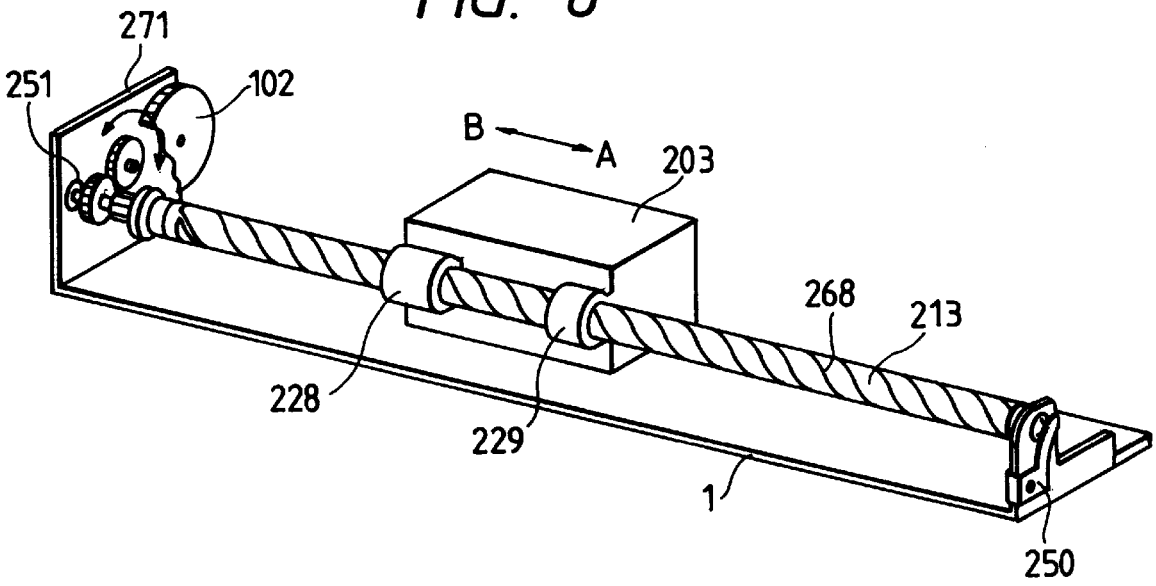
FIG. 6 is a view schematically illustrating the structure of a lead screw according to the first embodiment.

FIG. 6 is a view showing the lead screw mechanism to allow the carrier 203 to travel along the recording material 3. In FIG. 6, only the members needed for the execution of the required functions are represented.

The lead screw 213 is slidably fitted into the carrier bearings A 228 and B 229 provided for the carrier 203. The right-side end of the lead screw 213 is rotatively coupled to the chassis 1 through a adjustment spring 250.

The left-side end of the lead screw is rotatively coupled to a plate 271 through a bearing 251. The guiding part (not shown) of the carrier 203 engages with the guide rail 2 slidably in order to guide the carrier 203 while preventing it from rotating.

On the lead screw 213, a plurality of guide grooves 268 are formed, in one of which the lead pin 209 is slidably fitted to drive the carrier 203 in parallel to the axial direction of the lead screw 213 in the directions A and B.

Figure 7:
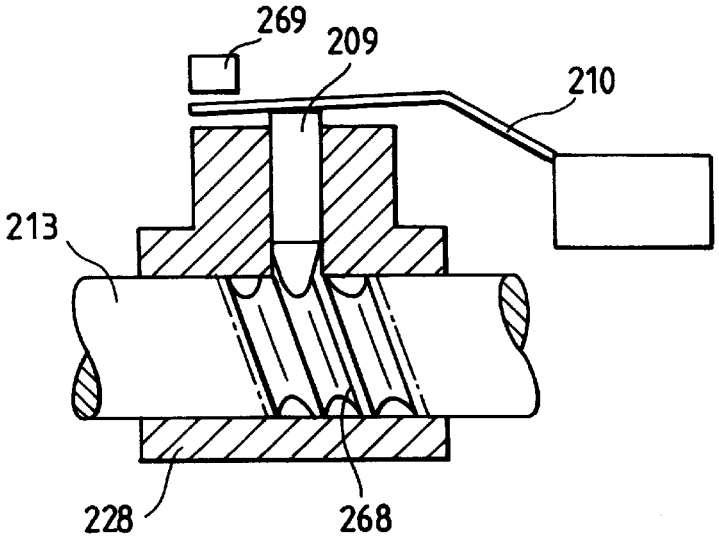
FIG. 7 is an enlarged cross-sectional view schematically showing a carrier bearing according to the first embodiment.

FIG. 7 is an enlarged cross-sectional view showing the carrier bearing A 228. The lead pin 209 is a pin which is processed to give a spherical form to one end thereof. This pin is slidably fitted into a hole formed in the carrier 203 main body between the carrier bearing A 228 and carrier bearing B 229 orthogonally to the axial direction of the lead screw 213. Its spherical part is slidably fitted into the lead screw 213, which is biased from the other end in the direction of the lead screw 213 by a lead pin spring detachably arranged for the carrier 203 main body. In this respect, the lead pin spring 210 may be a flat spring, coiled spring, or rubber if only the member is made of a resilient material capable of biasing the lead pin 209 to the direction of the lead screw 213.

On the upper part of the lead pin spring 210 in the sliding direction of the lead pin 209, a stopper 269 is provided in order to regulate the operational range of the lead pin 209 for the prevention of the displacement of the lead pin 209 from the guide groove 268.

Figure 8A:
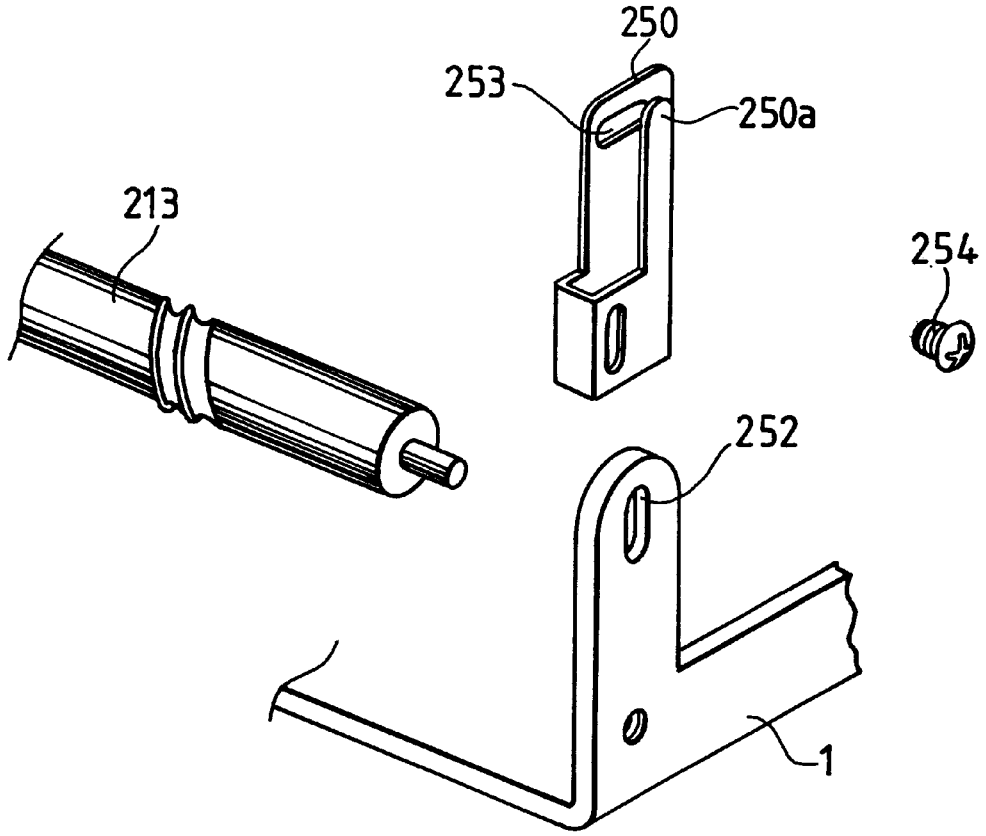
FIGS. 8A and 8B are enlarged views schematically showing the end portion of the lead screw according to the first embodiment.
Figure 8B:
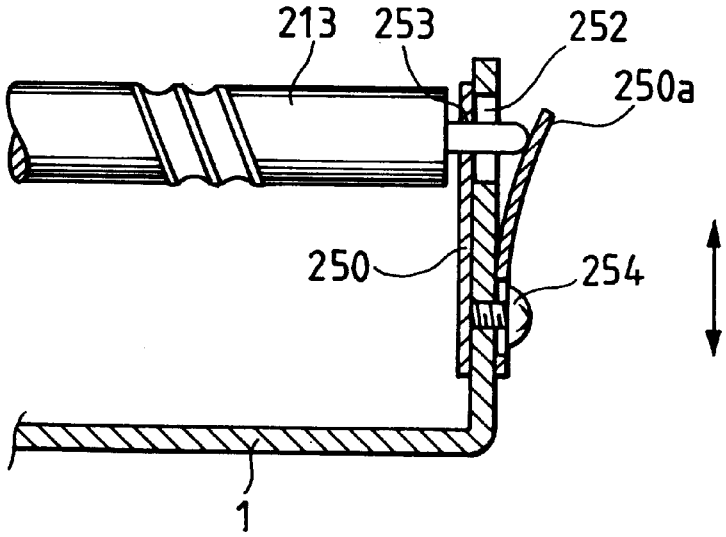

FIGS. 8A and 8B are enlarged views showing the end portion of the lead screw. The distance between the recording head 200 and the recording material 3 on the carrier 203 is determined by the distance from the recording material to the lead screw 213 which supports the carrier 203. Meanwhile, the left-side end of the lead screw 213 is positioned by the plate 271, and the right-side end thereof is made adjustable with the left-side end as reference for setting the lead screw 213 in parallel to the recording material 3. To this end, a first elongated hole 252 is formed on the chassis 1 orthogonally to the recording material 3.

A second elongated hole 253 is formed on an adjustment spring 250 for setting the adjustment spring 250 on the chassis 1 in order to arrange it in parallel with the recording material 3, and at the same time, regulating the operation of the right-side end of the lead screw 213 in the direction orthogonal to the recording material 3.

The right-side end of the lead screw 213 is supported by the first elongated hole 252 and the second elongated hole 253, and then, as the adjustment spring 250 on which the second elongated hole 253 is formed shifts orthogonally to the recording material 3 (in the direction indicated by an arrow in FIGS. 8A and 8B), the position of the lead screw 213 is adjusted to be in parallel to the recording material 3.

To the adjustment spring 250, a spring 250*a* is integrally formed to bias the right-side end of the lead screw 213 toward its left-side end. The adjustment spring 250 is fixed to the chassis 1 by means of a screw 254.

Figure 9:
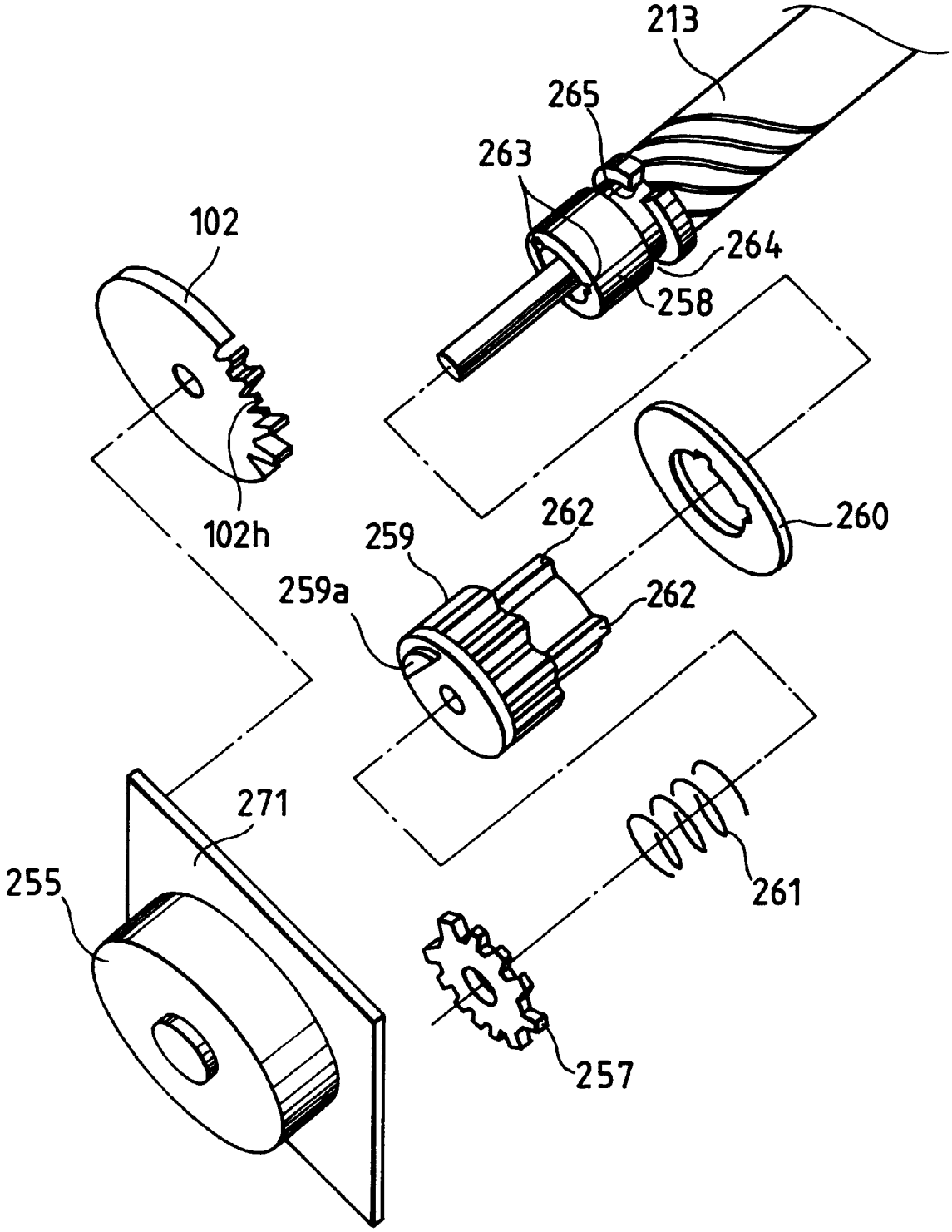
FIG. 9 is a view schematically showing the left-side end portion of the lead screw, on which a clutch mechanism is formed according to the first embodiment.

FIG. 9 is a view showing the left-side end of the lead screw 213 where a clutch mechanism is formed to transmit the driving force of the carrier motor 255 to a recovery system through the lead screw 213.

To the plate 271, the carrier motor 255 is coupled. A pinion gear 256 (see FIG. 1) is fixed to the shaft of the carrier motor 255, which engages with the lead screw gear 257 fixed to the lead screw 213. Hence the lead screw 213 is rotated regularly and reversely by the regular or reverse rotation of the carrier motor 255. In this way, the lead pin 209 which slidably abuts on the guiding thread 268 of the lead screw 213 enables the carrier 203 to travel along the guiding thread 268. In the plate 271, a control gear 102 is incorporated.

For the left-side end of the lead screw 213, an initial lock 258, a clutch plate 260, a clutch gear 259, and a return spring 261 are arranged.

The initial lock 258 is fixed to the lead screw 213. The clutch gear 259 is fitted to lead screw 213 slidably in the axial direction, and a part thereof is inserted into the initial lock 258.

In other words, an extrusion 262 is formed at two places, respectively, in the positions which are asymmetrically arranged on the circumference of the clutch gear 259. The extrusions 262 are fitted operationally only in the axial direction into the recesses 263 which are formed in the initial lock 258 at the same phases as the extrusions 262.

On the side end face of the clutch gear 259 on the lead screw 257 side, a flange 267 is provided. On the flange 267, a trigger tooth 259*a* is formed to give a rotational trigger to the control gear 102.

On the circumference of the control gear 102, a gear is formed in the position where it engages with the clutch gear 259 on the lead screw 213 when the lead screw 213 is incorporated with the plate 271. In a recording operation, however, the control gear 102 does not engage with the clutch gear 259 because a part of the gear, which is cut off, on the circumference of the control gear 102 faces the clutch gear 259.

On the side face of such cut-off gear, a side face gear 102*h* is formed with several teeth. This side face gear 102*h* engages with the trigger tooth 259*a* of the clutch gear 259 by a motion which will be described later, thus providing a rotational trigger for the control gear 102.

Between the initial lock 258 and the clutch gear 259, a clutch plate 260 is inserted. Further, the lead screw gear 257 is fixed to the lead screw 213. The return spring 261 is positioned between the clutch gear 259 and the lead screw 257 in order to bias the clutch gear 259 toward the initial lock 258 side at all times.

On the circumference of the initial lock 258, an idle groove 264 is formed in the same configuration as the thread of the lead screw 213, and engages with only the groove that guides the lead pin 209 through a connecting groove 265.

When the carrier motor 255 is rotated regularly, the carrier 203 advances in the direction indicated by an arrow A in FIGS. 4A and 4B. It advances in the direction indicated by an arrow B when the carrier motor is reversely rotated.

On the plate 271, an Hp sensor (see FIG. 1) is installed. Then it is arranged to detect the point at which the shielding board 230 (FIG. 1) formed on the carrier 203 passes the Hp sensor when the carrier motor 255 rotates to allow the carrier 203 to scan, thus making this point of the detection a fiducial point for the execution of a recording operation as well as a recovery operation which will be described later.

Figure 10A:
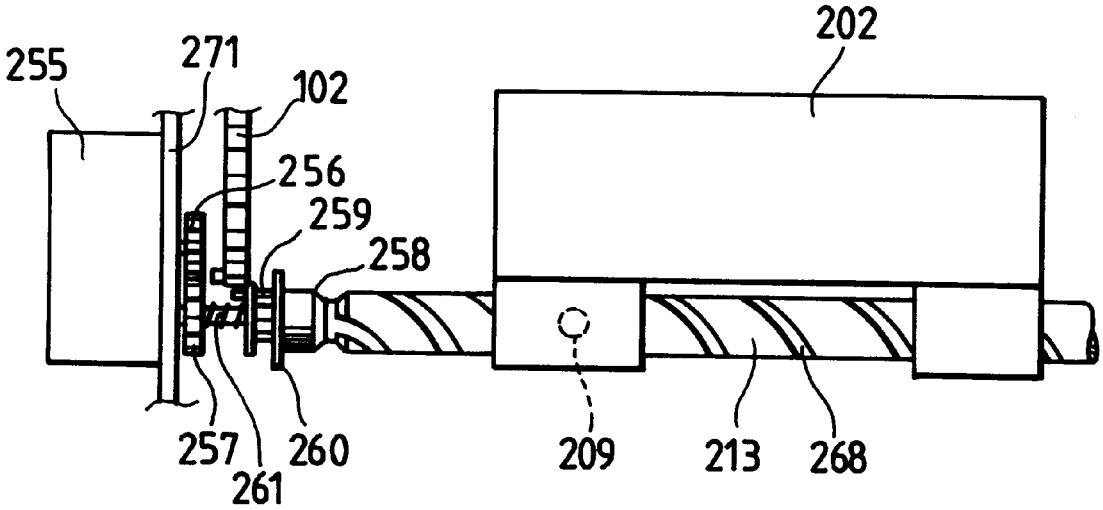
FIGS. 10A and 10B are views illustrating the operation of the clutch mechanism according to the first embodiment.
Figure 10B:
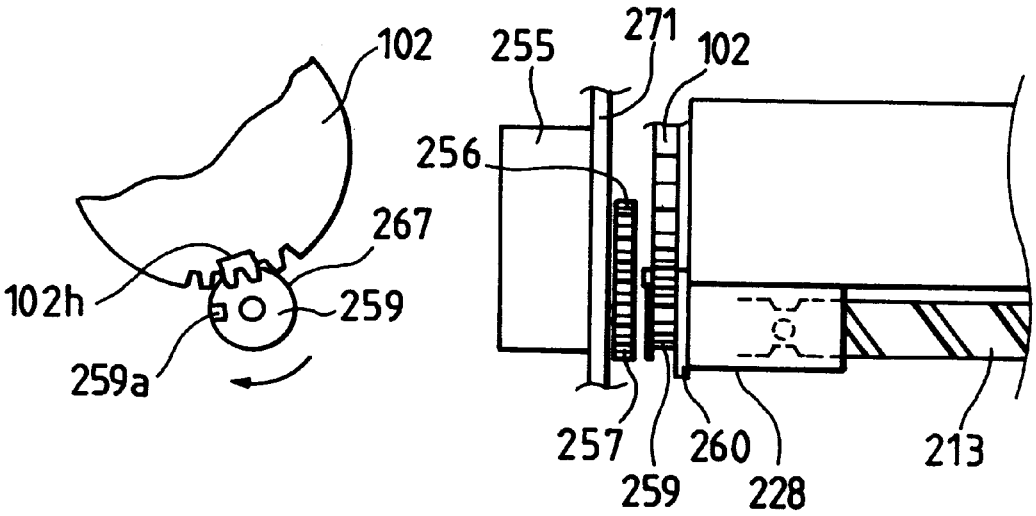

FIGS. 10A and 10B are views illustrating the operation of the clutch mechanism which transmits the driving force of the carrier motor 255 to a recovery system.

When the carrier motor 255 is reversely rotated in the state represented in FIG. 10A, the lead pin 209 causing the carrier 203 to travel enters the idle groove 264 of the initial lock 258 from the guiding thread 268 of the lead screw 213 via the connecting groove 265.

At this juncture, the end of the carrier bearing A at 228 presses the clutch plate 260 as shown in FIG. 10B, and in turn, the clutch plate 280 presses the clutch gear 259 to the position where it can engage with the control gear 102. Here, since the gear teeth are cut off on the control gear 102 side corresponding to the gear part of the clutch gear 259, the control gear 102 does not rotate.

Now, as the carrier motor 255 is further rotated reversely, the trigger gear 259*a* of the clutch gear 259 engages with the side face gear 102*h* of the control gear 102 to rotate the control gear 102, hence enabling the tooth part of the control gear 102 to engage with the clutch gear 259.

On the clutch gear 259, the flange 267 is formed. When the clutch gear 259 and the control gear 102 engage with each other, the flange 267 of the clutch gear 259 engages with the side face of the control gear 102. Thus the clutch gear is continuously in the engagement with the control gear 102. As the carrier motor 255 is further rotated reversely, a recovery operation is started.

After the completion of the recovery operation, the carrier motor 255 is regularly rotated. Then, when the control gear 102 and the clutch gear 259 return to the position where these gears have started making their engagement, the flange 267 of the clutch gear 259 disengages from the control gear 102. The clutch gear 259 tends to return to the original position due to the bias of the return spring 261. The clutch plate 260 which is fitted to the clutch gear 259 is pressed likewise, and also, the carrier bearing A of the carrier 203 at 228, which abuts on the clutch plate 260, is being pressed likewise.

As the carrier motor is further rotated regularly, the lead pin 209 which guides the carrier 203 is pressed out from the idle groove 264 on the circumference on the initial lock 258 to the guiding thread 268 side of the lead screw 213 via the connecting groove 265.

In other words, the carrier 203 is now in a state that it can scan by the rotation of the carrier motor 255.

Subsequently, the description will be made of the structure and electric circuit of an information processing apparatus in which a recording apparatus according to the present embodiment is incorporated.

Figure 11:
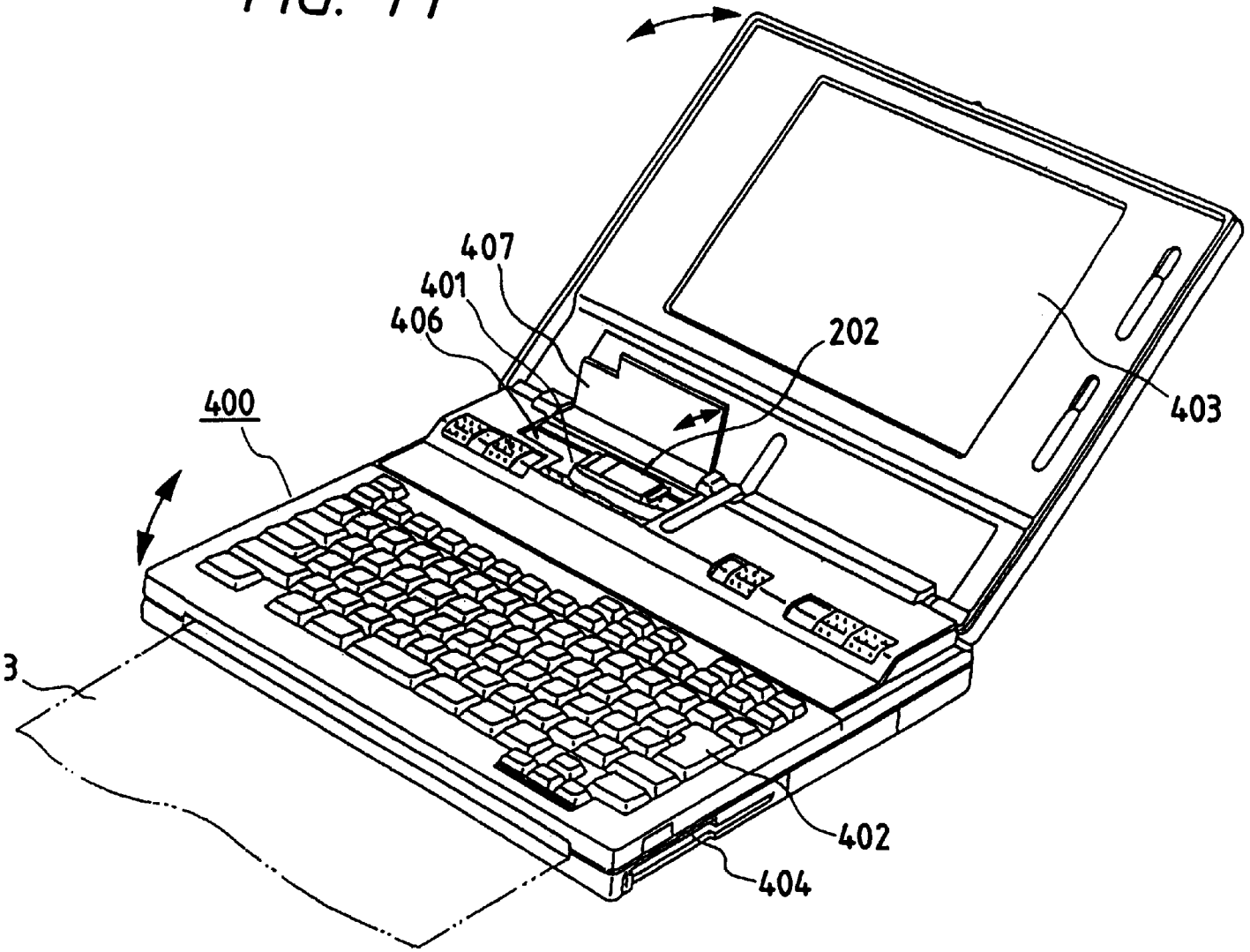
FIG. 11 is a perspective view schematically showing an information processing apparatus to which the first embodiment is applicable.

FIG. 11 is a perspective view schematically showing the external appearance of the information processing apparatus 400 to which the present embodiment is applicable.

In FIG. 11, a reference numeral 401 designates a printer unit; 402, a key board unit in which keys for inputting letters, numerals, and other characters, and keys for giving various instructions are provided; 403, a display unit having a display; 404, an external storage such as a floppy disc; 406, a printer aperture provided for the housing in order to operate the printer unit 401 from outside; and 407, a printer cover to close the printer aperture 406 when the printer unit 401 is not used for operation.

Figure 12:
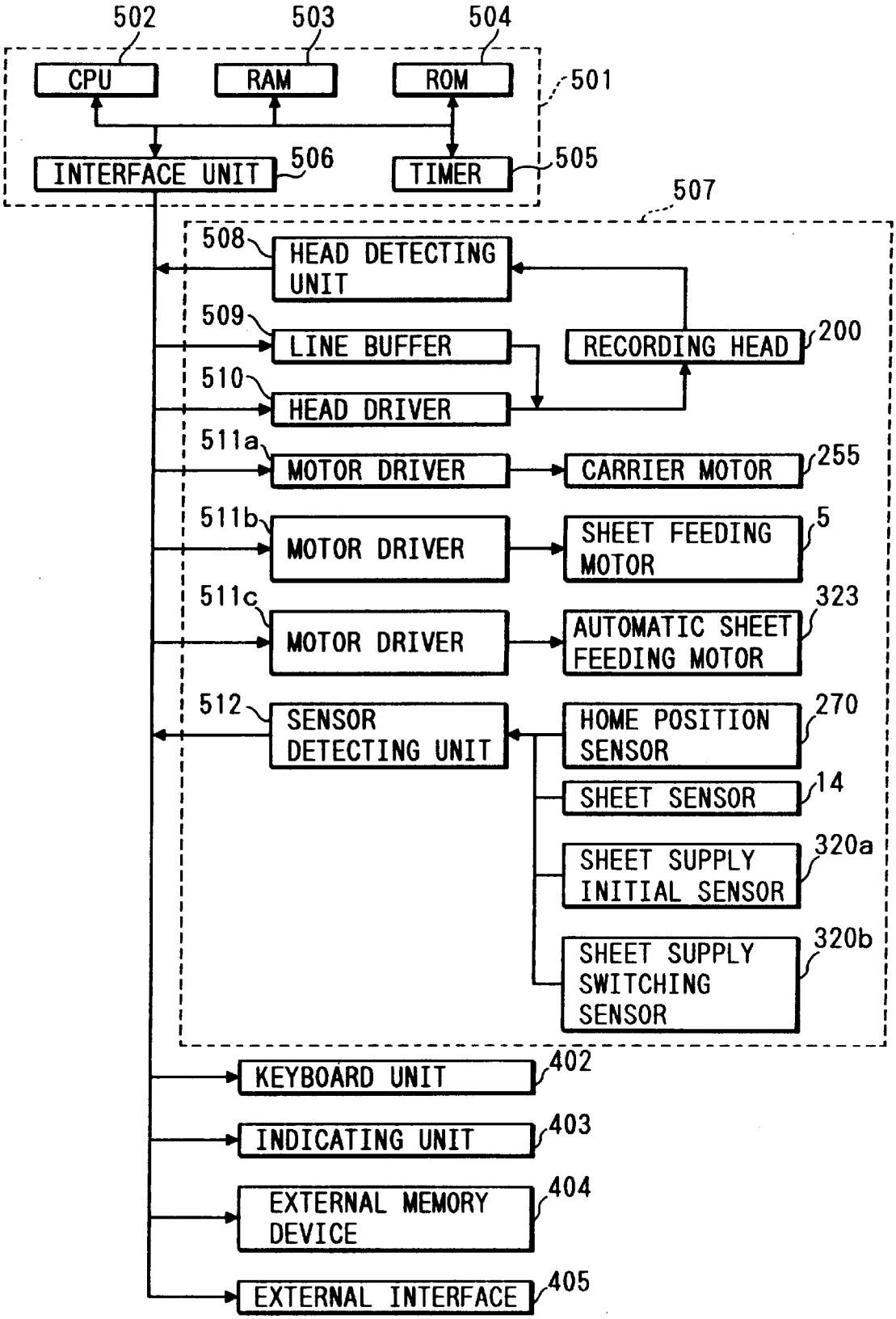
FIG. 12 is a block diagram representing the structure of an electric circuit for an information processing apparatus.

FIG. 12 is a block diagram showing the structure of the electric circuit of the information processing apparatus according to the present embodiment. In FIG. 12, a reference numeral 501 designates a controller to execute main controlling processes; 502, a CPU arranged in the mode of a microcomputer, for example, which executes a certain procedure; 503, a RAM having an area for developing the text data and image data, and a working area as well; 504, a ROM storing the program for the aforesaid procedure as well as font data and other fixed data; 505, a timer producing the execution cycles for the CPU 502, and the timing required for the printer unit 401 to execute the recording operations; 506, an interface unit connecting the signals from the CPU 502 to the peripheral devices; and also, 507, a controller for the printer unit 401; 508, a head detection unit for detecting the information regarding the recording head, such as the presence and absence, the kinds, and the output of a temperature sensor for the recording head 200, and the output of a sensor which detects the presence and absence of ink in the ink tank 201; 509, a line buffer for storing the recording data for the recording head 200; 510, a head driver for supplying the recording signals and electric power to the recording head 200; 511*a*, 511*b*, and 511*c*, motor drivers for supplying the required signals and power to drive a carrier motor 255, a feed motor 5, and an automatic feeder motor 323 (when an automatic sheet feeder is installed); 512, a sensor detecting unit for detecting the outputs from a home position sensor 270, a sheet sensor 14, a sheet supply initial sensor 320*a*, a sheet supply switching sensor 320*b*, and others; and further, 404, external memory devices such an FDD, an HDD, a RAM card, and others; and 405, an external interface for communicating with the other information processing apparatuses, and for controlling the peripheral device by directly connecting them to the inner buses, for example. Although not included in the block diagram shown in FIG. 12, there is a power-supply unit which supplies power to the above-mentioned electric circuit. For the power-supply, there is provided a rechargeable battery, disposable dry cells, or an adapter for the AC power-supply which is usable when the information processing apparatus is used stationarily.

When the apparatus is out of recording operation, the carrier for the printer unit 401 is in such a state that the lead pin 209 is inserted into the idle groove 264 of the aforesaid initial lock 258 (hereinafter, this state is referred to as home position). In this state, the head lever 204 and the tank lever 205 cannot be operated through the printer aperture 406. This is because there is a possibility that the aforesaid cap 101 damages the ink discharging surface of the recording head 200 if the attachment or detachment of the recording head 200 is executed at the home position, and it is necessary to prevent any damage from being caused to the foregoing surface of the recording head. Therefore, when the recording head 200 or the ink tank 201 should be replaced, the carrier is moved from the home position to the location where the head lever 204 and the tank lever 205 can be handled through the printer aperture 406 (hereinafter, this position is referred to as replacement position). To move the carrier 203 to the replacement position, it may be possible to input an instruction through a control key arranged on the key board unit 402 for control of the printer unit 401 or it may be possible to control the required movement by an application of a given timing through an instruction arranged in a soft ware.

The head lever 204 or the tank lever 205 should be used in the replacement position, but in the present embodiment, the lever is operated in the same direction as the scanning direction of the carrier 203 as described earlier. Therefore, the carrier tends to move in the direction of the force added to the carrier 203 when the lever is operated. If the carrier 203 should move, the operation of the lever is not appropriately executed. In the present embodiment, therefore, the position of the carrier 203 is fixed in the method given below.

In other words, as described earlier, the rotational force of the carrier motor 255 is transmitted to the lead screw 213 through the gears, and in turn, transmitted to the carrier 203 by the lead pin 209 which engages with the guiding thread 268 of the lead screw 213. Therefore, if the rotation of the carrier motor 255 is suspended and fixed, the rotation of the lead screw 213 is also suppressed. As a result, the lead pin 209 cannot move in the scanning direction, making it possible to determine the position of the carrier 203 uniquely.

Particularly, when the carrier motor 255 is the so-called stepping motor which is rotative per given angle, it is possible to suspend and fix the rotational shaft easily by holding an excitation at an arbitrary phase of it. Therefore, it is preferable to use a motor of such a type. Of course, it may be possible to use an AC motor or a DC motor with the provision of a clutch and a brake.

Also, when the rotation is suspended and fixed by fixing the excitation at an arbitrary excitation phase using a stepping motor, the temperature of the motor rises by the heat generated in the inner coil if the suspension period is considerably long. Therefore, it may be possible to reduce the current flowing in the motor in the period during which its rotation is suspended and fixed so that the motor temperature is prevented from being raised.

Now, the lead pin 209 is installed on the carrier 203 through the lead pin spring 210, but in a case such as above, when the lead screw 213 is fixed and an external force is given to the carrier 203, the lead pin spring 210 which is a resilient member can be deformed and may jump over the guiding thread 268. There is a possibility that the so-called tooth jump phenomenon is created.

Figure 13:
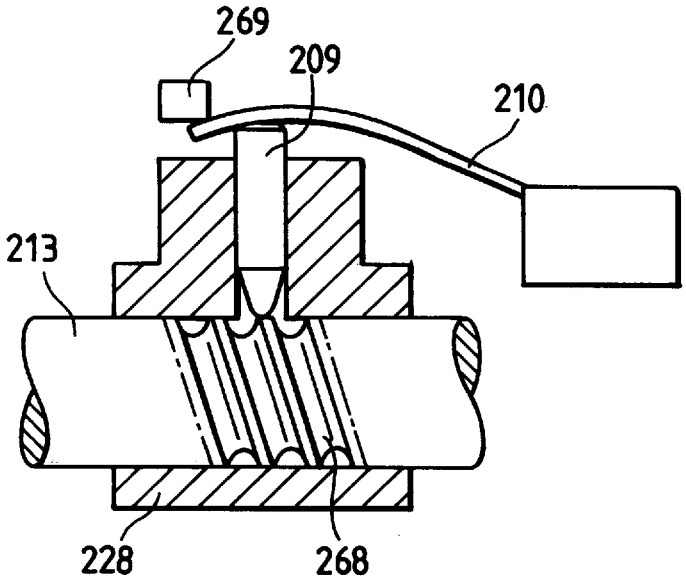
FIG. 13 is a cross-sectional view schematically showing the state of a lead pin skipping over the tooth according to the first embodiment.

FIG. 13 is a view showing the relationship between the lead pin 209 and the lead screw 213 when such a tooth jump phenomenon takes place.

When correlated forces are exerted between the lead pin 209 and lead screw 213, a load is applied to the inclined face of the guiding thread 268 and the leading end of the lead pin 209. By the upward component of such load in FIG. 13, the lead pin 209 is pressed upward. Usually, the upward movement of the lead pin 209 is regulated by the stopper 269 which regulates the amount of movement of the lead pin spring 210. However, if an excessive force is exerted, the lead pin spring 210 creates a plastic deformation, thus resulting in the possibility that the lead pin jumps over the guiding thread 268 as shown in FIG. 13.

When the tooth jump phenomenon is created, the guiding thread 268 is displaced from the position originally defined, and when returning to the home position, it cannot enter the connecting groove 265 of initial lock 258, thus disabling its return to the home position eventually. Therefore, if any excessive force is exerted on the carrier 203 in the replacement position, the suspension and fixation of the carrier motor 255 is released. In this way, the lead screw 213 rotates. The relationship is thus established to avoid any occurrence of the tooth jump.

Here, it is assumed that a force F1 is given in the scanning direction of the carrier 203 while the lead screw 213 is fixed. Also, it is assumed that the lead pin 209 in FIG. 6 is fixed to the carrier 203 without any inclusion of resilient member, and a force F2 is added in the direction A in FIG. 6. Then the rotational shaft of the carrier motor 255 is assumed to have begun rotating in the direction C in FIG. 6 (that is, the direction D when the force F2 is added in the direction B in FIG. 6). Then the following relationship is arranged to exist between the forces F1 and F2:

$$F1>F2$$

If the above-mentioned relationship is satisfied, it is possible to avoid the tooth jump of the lead pin 209 even when an excessive force is exerted on the carrier 203 in the replacement position because the state of the carrier motor 255 to hold the fixation can be released.

A specific means to set the force F1 is adjustable by designing the spring invariable and the allowable stress of the lead pin spring 210 or by designing the space between the lead pin spring 210 and the stopper 269. A specific means to set the force F2 can be established by adjusting the excited current or excited voltage when the carrier 203 is in the replacement position.

By executing the operation of the carrier levers as above, the effects are obtainable as given below.

In other words, a replacement position is defined, and an arrangement is made so that no lever operation is possible in any positions other than the replacement position thus defined. In this way, it is possible to prevent any breakdown from occurring on the ink discharging surface of the recording head. Also, the fixation of the carrier position is executed by suspending the rotation of the carrier motor. In this way, it becomes unnecessary to provide any special mechanism to fix the carrier, hence effectively miniaturizing the apparatus and lowering the cost of the apparatus as well.

Also, in operating the lever, it is possible to avoid the tooth jump of the lead pin by setting the force to hold the suspension of the carrier motor rotation and the force to support the lead pin appropriately, thus significantly improving the reliability.

Now, the description will be made of an embodiment in which to prevent the recording head 200 from being damaged due to the rubbing between the discharging nozzles 606 and the cap 602 when the recording head 200 is capped in the home position of the recording head 200 which is separable from the ink tank 201. Here, a window 803, which is prepared by cutting off a part of the cover 407, extends to the home position of the carriage. When the carriage is in the home position, the rotational operation of the lever 703 is enabled, although the operation of the lever 702 is disabled from outside the window. As a result, it becomes possible to remove and replace ink tanks while prohibiting the replacement of the recording head 200.

With such a structure arranged as above in the present embodiment, it is possible to detach only the ink tank without affecting the recording head at all even when the recording head is capped in the home position for its protection.

Figure 14:
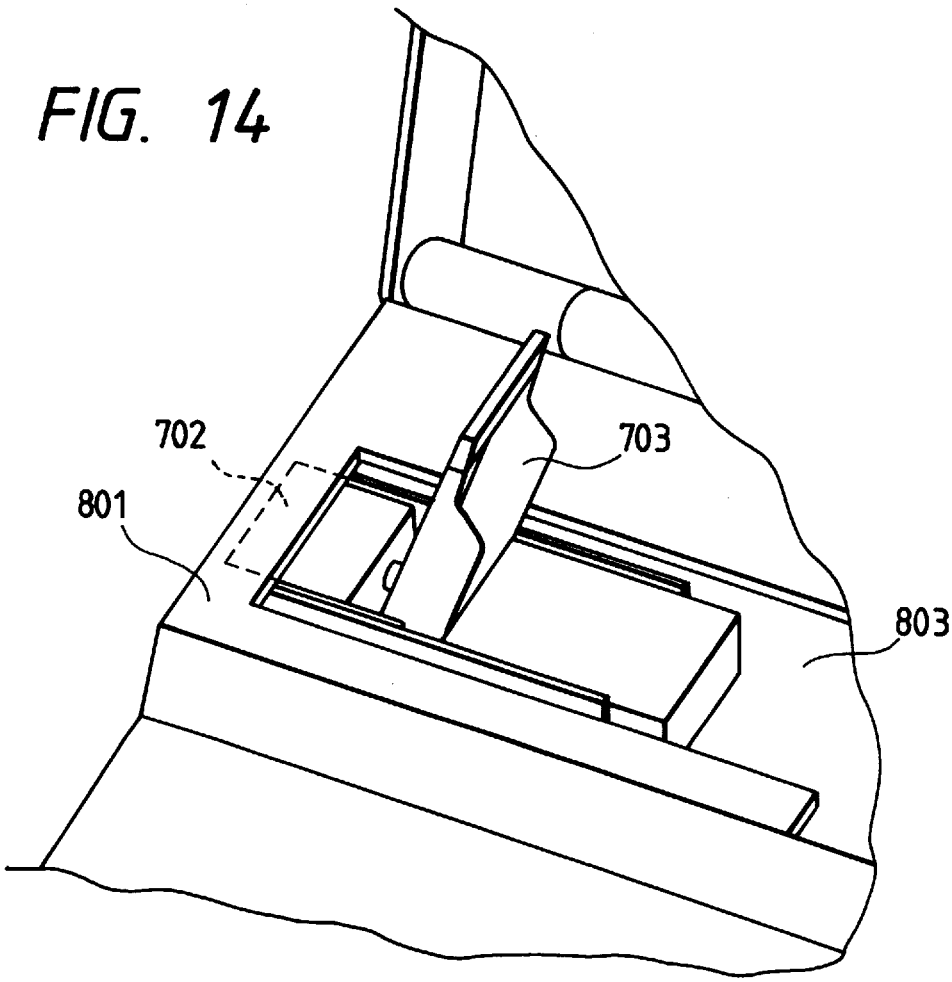
FIG. 14 is a view schematically showing a second embodiment.

FIG. 14 shows such an embodiment as this. Here, the ink tank is detachable in the home position, but the first lever 702 for detaching the recording head is covered with an external element 801, which is not arranged in the recording apparatus, so that any malfunction can be avoided because the detachment and attachment of the recording head in the home position causes the recording head and the cap to rub each other. With this arrangement, the rotational operation of the lever 702 is disabled in order to prohibit the integral replacement of the recording head and ink tank, thus avoiding any rubbing between the recording head and cap.

Figure 15:
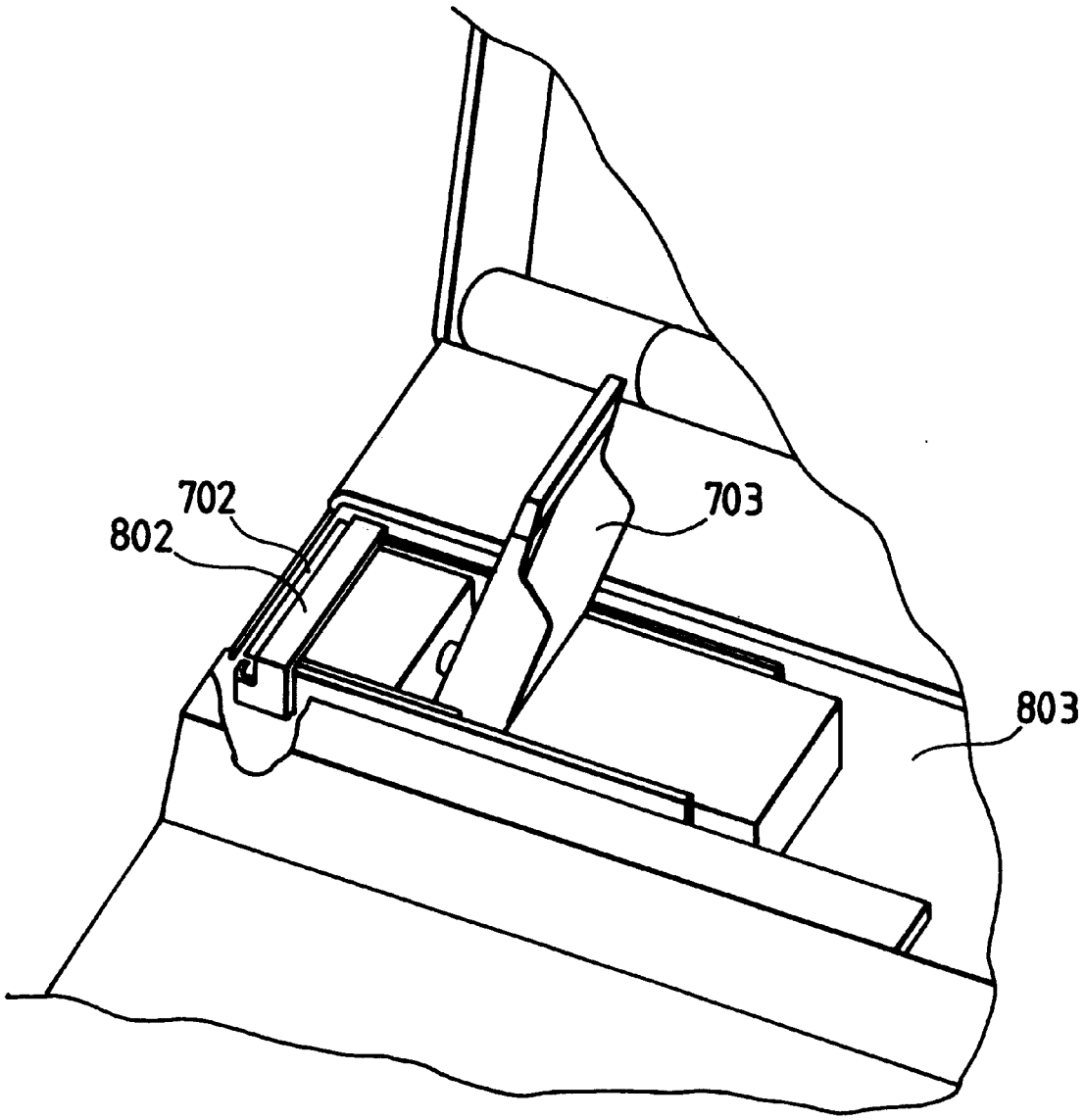
FIG. 15 is a view schematically showing a third embodiment.

FIG. 15 shows another embodiment. Here, the ink tank is detachable in the home position, but the first lever 702 for detaching the recording head is covered with a cover 802 arranged by the side plate or the chassis, which is a part of the recording apparatus, so that any malfunction can be avoided because the detachment and attachment of the recording head in the home position create the rubbing between the recording head and the cap. With this arrangement, the rotational operation of the lever 702 is disabled.

Figure 16:
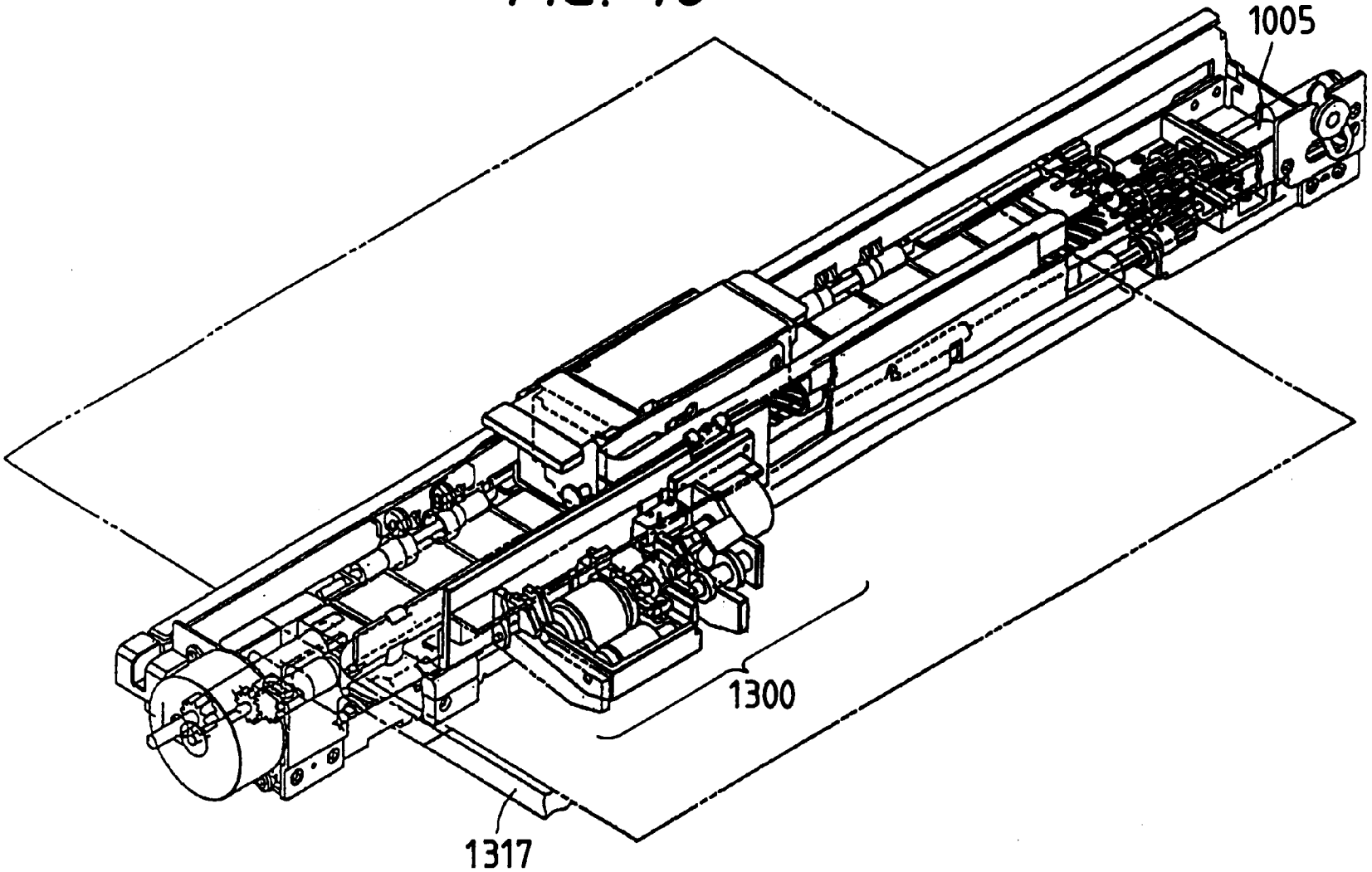
FIG. 16 is a perspective view showing a case of an automatic sheet feeder being installed.

FIG. 16 shows the state that an automatic sheet feeder is installed on the recording apparatus shown in FIG. 1. Here, a reference numeral 1300 designates an automatic sheet feeding unit which is fixed to the recording apparatus in a position indicated in FIG. 16.

Of the recording materials stacked and held on a sheet holder 1317, one sheet is fed after another by the automatic sheet feeding unit in accordance with recording signals from a personal computer or other information processing apparatus or by the depression of a sheet feeding key provided for the recording apparatus.

Figure 17:
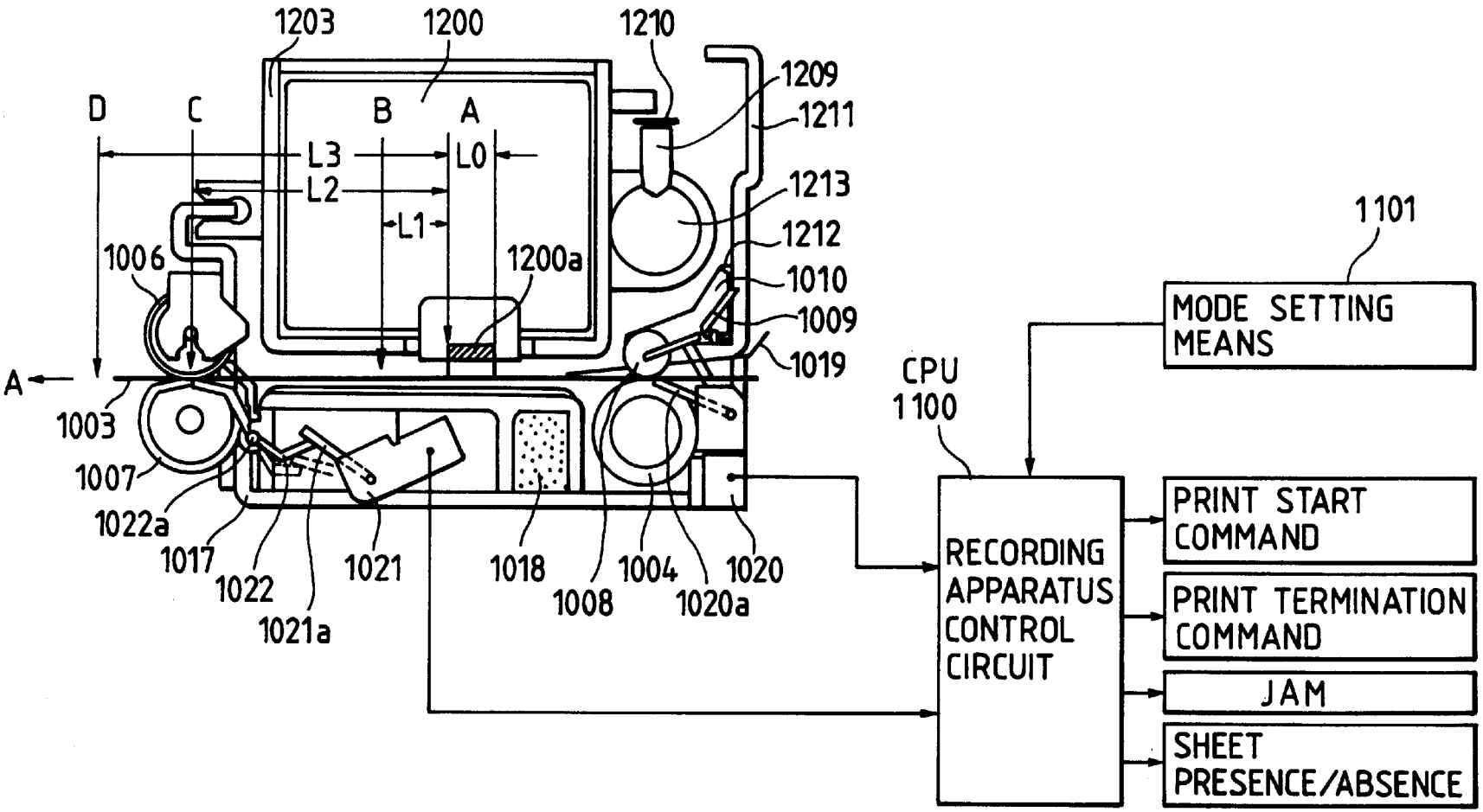
FIG. 17 is a side view showing the recording unit represented in FIG. 16.

FIG. 17 is a cross-sectional view showing the portion of the apparatus which include sensors. Here, this portion will be described specifically.

A recording material 1003 in a position facing the discharging port unit (nozzles) 1200*a* of a recording head 1200 is pressed to a feed roller 1004 by a pinch roller 1008. By appropriately rotating the feed roller 1004 with a feed motor 1005, the recording material is conveyed to the recording position as required. Here, the recording position means the range in which the recording is made by the nozzles 1200*a*, and in FIG. 17, it is the position corresponding to a portion of the recording material designated by a reference mark L0. Then, after the completion of recording, the recording material 1003 is pressed to an exhaust roller 1007 by a spur 1006, and exhausted by the rotation of the exhaust roller 1007 to the outside of the apparatus.

Here, a reference numeral 1020 designates an inlet detection sensor for recording material, and 1021, an outlet detection sensor for recording material. In the present embodiment, both of them are sensors of the same type. When a recording material 1003 is present, levers 1020*a* and 1021*a* are depressed to close the electrical contacts for conduction, hence detecting the presence of the recording material 1003.

In FIG. 17, two-dot chain lines indicate the lever positions when no recording material 1003 is present. On the inlet side, the recording material 1003 presses the sensor lever 1020*a* directly. On the outlet side, however, since the exhaust roller 1007 on the recording surface side deforms itself in accordance with the thickness of the recording material, it is impossible to set the mounting height of the sensor corresponding to that of the inlet side. Therefore, the lever 1021*a* is pressed with the inclusion of another member, a lever 1022, which can freely swing around the shaft 1022*a*.

If the sensors are sufficiently small, it may be possible to mount the sensor on the outlet side as it is without any inclusion of the lever 1022. In either case, the lever which abuts on the recording material 1003 should be arranged in such a manner that the leading end of the lever does not extrude from the exhaust roller 1007 and yet the roller should be set on as far downstream side as possible. If the leading end of the lever should extrude from the roller, the trailing end of the recording material 1003 depresses the leading end of the lever despite the recording material is being exhausted. Then the sensor detects it and indicates errorneously as if a recording material is present. Also, by setting the sensor on the downstream side as far as possible, it can be assured that the leading end of the recording material 1003 exists between the spur 1006 and the exhaust roller 1007.

Now, in a recording apparatus in general, there is no possibility that a recording is started at the very top of the leading end of a recording material due to the mechanical structure or for the convenience sake of an information processing apparatus. Usually, a certain margin is provided for initiating the recording. Then the recording apparatus starts feeding a sheet when its sheet feeding key is depressed or by the reception of a recording signal when the automatic sheet feeder is employed. In this case, irrespective of any information signals (recording signals) being received from the outside, the leading end of the recording material 1003 is conveyed to a position corresponding to the predetermined marginal point on the downstream side of the discharging unit 1200*a* in accordance with a control made by the control circuit 1100 arranged for the recording apparatus itself. This position may be called a head marginal position. The head marginal position can be selected from among several kinds of preset margins by use of mode setting means 1101 depending on the hardware types of computer, word processor, or the like, or the like to which the recording apparatus is connected.

Now, in FIG. 17, given the end of the downstream side of the nozzles 1200*a* of the recording head as a point A, the head marginal position will be a point B if the upper margin is set narrowly at L1 by use of mode setting means 1101. If the upper margin is set widely at L3, the head marginal position will be a point D. Given a point C as the position where the outlet sensor for recording material detects the leading end of the recording material 3, the recording should only be executed in accordance with the recording signals by conveying the recording material 3 to the point D as it is when the upper margin is at L3. To convey the recording material to the point D, it will be good enough just by driving the feed rollers 1004 and 1007 to feed the recording material for a distance between L3 and L2 after detecting the recording material by use of the sensor 1021 for detecting it. To this end, the feeding motor 1005 is driven for a given period of time after the sensor 1021 has detected the recording material or after a given pulse if a motor is employed, and then, the rotation of the motor is suspended.

If the upper margin set by the control circuit 1100 of the recording apparatus is the L1, it becomes impossible to confirm whether or not the recording material has been conveyed correctly when the recording material 1003 stops at the point B. Hence the recording material 1003 should be fed once to enable its leading end to reach the point C, and then, it should be confirmed whether or not the recording material has been conveyed correctly. After that, the recording material 1003 must be fed back for the given pulse numbers.

However, even when the head marginal position is set at the point B, the actual recording data should not necessarily be positioned with the above-mentioned margin L1 (as an example, when a command to set a margin for a given length is included in information signals or several lines in the initial stage are paragraphed). Therefore, if actual recording signals include a command to set a margin, the recording material 1003 which has once been conveyed to the point C should be returned to the point B, and then, the recording material 1003 is fed again to the downstream side without recording. Because of this, a useless feeding operation is executed before an actual recording begins.

According to the present invention, therefore, even when the outlet sensor for recording material 1021 is set on the upstream side of the position for the detection of the recording material 1003 as in the case of the head marginal position being set at the point B, the recording material is conveyed to the point C by the feeding operation, that is, until the outlet sensor for recording material 1021 detects the leading end of the recording material 1003, and then, the length of the upper margin indicated by the actual recording signal is compared with the L2 at that position. In this way, only when it is found that such an actual upper margin is shorter than the L2, the recording material is fed back only for the required amount, thus executing the recording.

Figure 18:
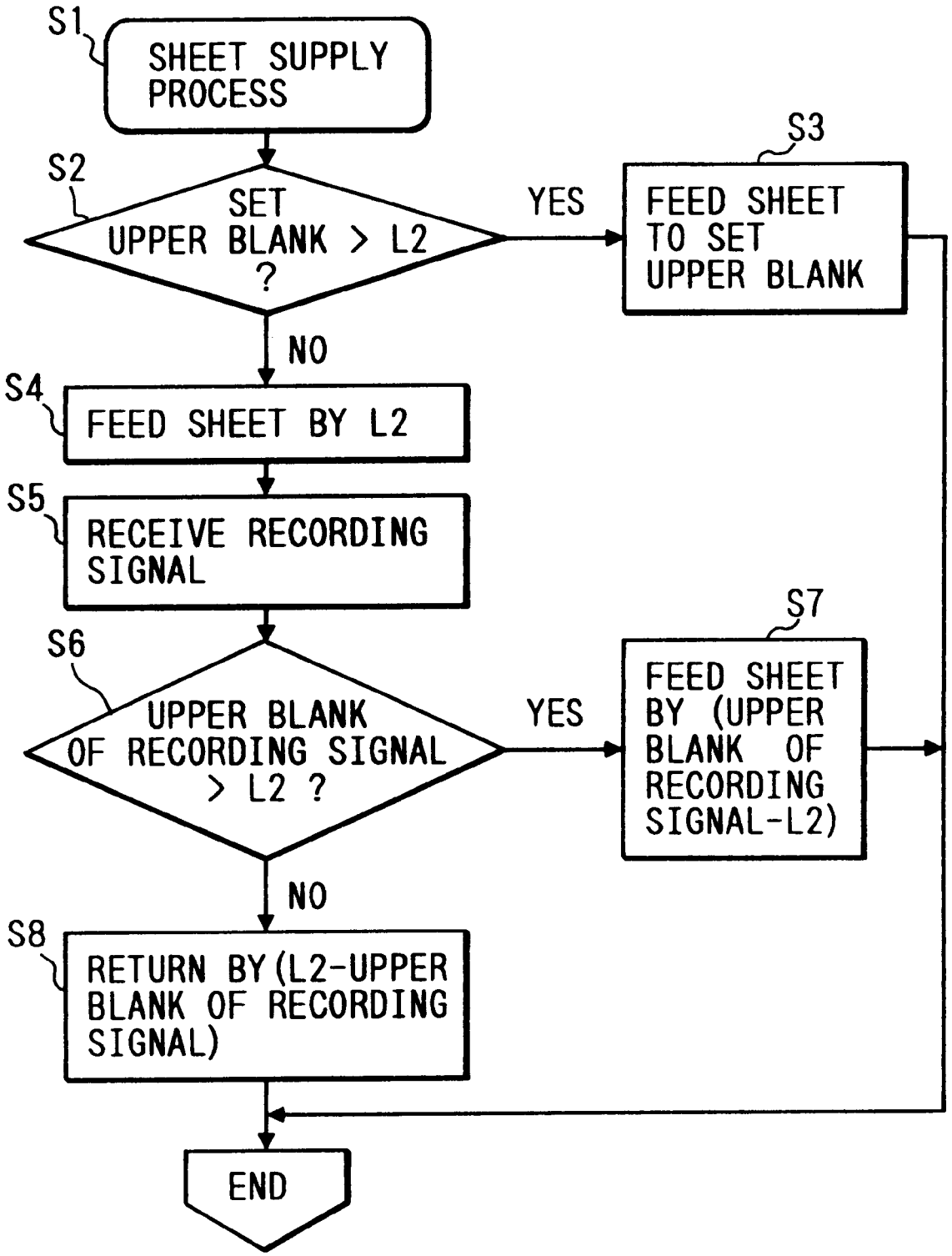
FIG. 18 is a flowchart for the control of the recording apparatus shown in FIG. 16.

This operation will be described in detail with reference to a flowchart shown in FIG. 18. A feeding process (step S1) is started in accordance with a feeding signal or a recording signal transmitted from a computer or other external apparatus or a feeding signal transmitted from the sheet feeding key. In step S2, whether or not the set upper margin is greater than the L2 is determined. If the margin is greater than the L2, the process will proceed to step S3 and convey the leading end of the recording material to the position (point D, for example) corresponding to a margin set on the downstream side of the point C.

If the set upper margin is smaller than the L2, the process will proceed to step S4 and convey the recording material whereby to feed the leading end of the recording material to the point C by stopping it where the leading end of the recording material is detected by the sensor 1021. After that, in step S5, recording signals are received, and it is determined whether or not the upper margin to the position for the recording to begin is greater than the L2. If the actual margin is greater than the L2, the process will proceed to step S7 and convey the recording material to the portion corresponding to the actual margin on the downstream side of the point C.

If the actual margin is smaller than the L2, the process will proceed to step S8 and feed back the recording material for a portion equivalent to an amount of the L2—the actual upper margin.

In order to feed the sheet by the operation of the sheet feeding key before receiving recording signals, the feeding operation is once suspended when the recording material arrives at the point C, and then, the operation is on standby waiting for the recording signals. When the automatic sheet feeder 1300 is used, the sheet feeding operation begins at receiving the recording signals, thus operating the sheet feeding continuously until the recording is started without any useless interruption before the reception of the recording signals.

Figure 19A:
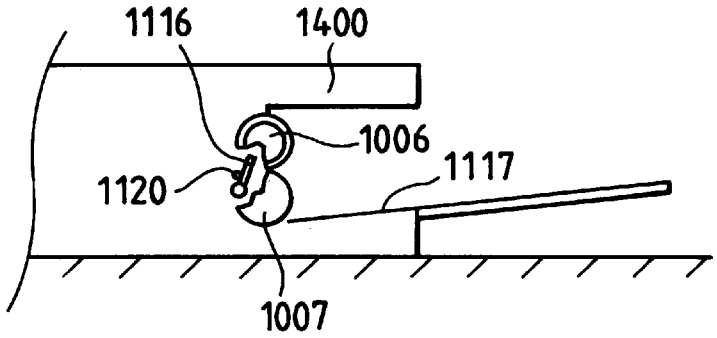
FIGS. 19A to 19C are cross-sectional views schematically showing the vicinity of the exhaust section of the recording unit shown in FIG. 16, which is provided with preventive means for retrograde motion.
Figure 19B:
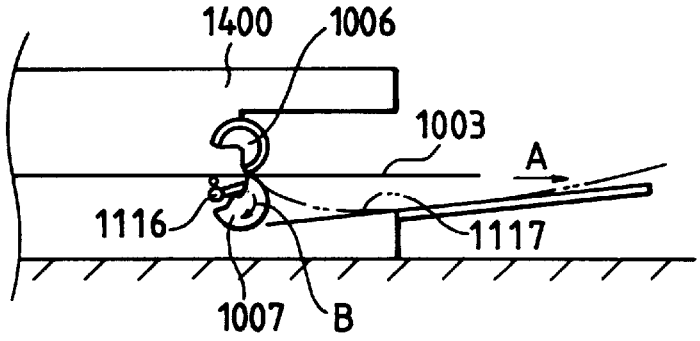
Figure 19C:
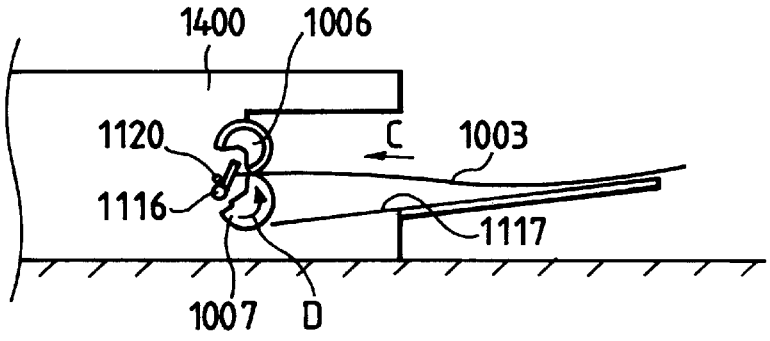

FIGS. 19A to 19C are cross-sectional views schematically showing the exhaust unit represented in FIG. 17. In FIGS. 19A to 19C, a portion on the left-hand side corresponds to the feeding unit. The recording material is conveyed in the direction from the left side to the right side. A reference numeral 1400 designates a housing of an information processing apparatus, and 1117, an exhaust sheet tray 1117 arranged at a part of the housing. Although the exhaust sheet tray is represented in a short length, the tray may be extended by use of an auxiliary member in the feeding direction of the recording material 1003. After the completion of recording, the recording material 1003 is exhausted outside the apparatus, and stacked onto the exhaust sheet tray 1117 for delivery. In this respect, it is of course possible to adopt a type whereby to incorporate an exhaust sheet tray 1117 completely in the housing including the extended auxiliary member.

A reference numeral 1116 designates an exhaust sheet lever which serves as backward feed preventive means to avoid any retrogression of the recording material. The exhaust sheet lever 1116 is arranged in two locations, one each in the left- and right-hand sides, appropriately in the path which the recording material 1003 passes in the vicinity of the exhaust roller 1007. In the present embodiment, the exhaust sheet lever 1116 is mounted on a member which constitutes the sheet path, and is rotative within given angles around the rotational shaft which is not shown. In this respect, the exhaust sheet lever 1116 may be mounted on any position where it can be mounted, such as the frame of the recording apparatus. Here, in order to make it easy to observe the exhaust sheet lever 1116, the spur 1006 and exhaust roller 1007 are partly cut off in its representation.

FIG. 19A shows a state before the recording material 1003 reaches the exhaust unit. To the exhaust sheet lever 1116, a rotational force is given (counter-clock wise by a spring member in FIG. 19A), which is just good enough so that no advancement of the recording material 1003 should be hindered. The lever stops because it is biased by a stopper 1120.

Now, FIG. 19B shows a state that the recording material 1003 approaches the exhaust unit. When the recording material 1003 approaches the exhaust unit, the leading end of the recording material 1003 abuts on the exhaust sheet lever 1116 at first. At this juncture, the exhaust sheet lever 1116 is pressed by the recording material 1003 to begin rotating clockwise, and rotates to the position of the exhaust sheet lever 1116 indicated in FIGS. 19A to 19C. At the same time that the exhaust sheet lever 1116 begins to rotate, the recording material 1003 is drawn between the exhaust roller 1007 and the spur 1006. Thus, by the rotation of the exhaust roller in the direction B as described earlier, the recording material is conveyed in the direction A in FIGS. 19A to 19C. This state continues until the tailing end of the recording material 1003 passes the exhaust roller 1007.

When the tailing end of the recording material 1003 passes the exhaust roller 1007, the exhaust sheet lever 1116 is rotated counter-clock wise by the application of the aforesaid rotational force, and then, when abutting on the stopper 1120, it returns to the position indicated in FIG. 19A. Also, the recording materials 1003 are stacked on the exhaust sheet tray 1117 with its trailing end of each material being placed on it one after another.

However, in order to suppress the height in the vertical direction of the exhaust sheet tray 1117, the difference in height between the exhaust roller 1007 and tray is made small. Therefore, the trailing end of the recording material 1003 thus exhausted in this state is located extremely close to the exhaust roller 1007. If an external force should be exerted on the recording material 1003 to press it back, there is a possibility that the trailing end of the recording material 1003 abuts on the exhaust roller 1007. If the next recording is executed in such a state as this, and the next recording material is fed, there is a possibility that the recording material 1003 which has already been exhausted is again drawn into the recording apparatus along with a backward feed which may be executed for the purpose of removing any slack of the recording material or adjusting the head marginal position because the exhaust roller 1007 is then rotated in the direction D indicated in FIG. 19C.

According to the present embodiment, however, as shown in FIG. 19C, the trailing end (or the leading end in the feeding direction C) of the recording material 1003 conveyed in the direction C by the rotation of the exhaust roller 1007 in the direction D abuts on the exhaust sheet lever 1116. Since the rotation of the exhaust sheet lever is suspended by the stopper which is not shown, the advancement of the recording material 1003 is hindered even if it is still in progress. As a result, a slippage occurs between the exhaust roller 1007 and the recording material 1003, thus disabling the transmission of the driving force of the exhaust roller 1007. With the movement described above, there is no possibility at all that the recording material 1003 which has once been exhausted will again enter the recording apparatus.

As described above, the difference in the height between the exhaust roller 1007 and the exhaust sheet tray 1117 is made small, and the exhaust sheet lever 1116 is arranged in the vicinity of the exhaust roller 1007, hence making it possible to prevent the exhausted recording material 1003 from being fed back to the recording apparatus. Also, since there is no need for providing any extra difference in the height required for dropping the recording material 1003, there is an effect that the apparatus can be miniaturized.

Further, it may be possible to provide the exhaust sheet lever 1116 with an additional function to detect the presence or absence of the recording material 1003. This arrangement can be materialized by structuring the exhaust sheet lever 1116 with the spring switch as in the aforesaid sheet sensor 1021, for example, or by combining a light emitting diode and a phototransistor within an operational range of the exhaust sheet lever 1116.

If the exhaust sheet lever 1116 is made a sensor for detecting the presence or absence of the sheet in this manner, it is possible to detect whether or not the recording material 1003 is present in the position of the exhaust sheet lever 1116 when the recording material 1003, having passed the sheet sensor 1021, is conveyed by use of the feed roller 1004 for a given amount to arrive at the position of the exhaust sheet lever 1116. If the presence of the recording material 1003 is detected, it can be confirmed that the feeding of the recording material has been carried out normally. If no presence of the recording material 1003 is detected, it can be interpreted that the feeding of the recording material has failed, and that a jamming has taken place in the feeding path. If any existence of jamming is thus detected, the recording operation thereafter is immediately suspended, and a warning is issued accordingly, hence making it possible to prevent the recording head from being damaged, and also, to avoid any useless printing on the constituent of the sheet passage.

As described above, by making the exhaust sheet lever 1116 dually functionable as a sensor for detecting the presence or absence of the recording material, it becomes possible to detect any abnormality in conveying the recording material 1003 between the feed roller 1004 and the exhaust roller 1007. In this way, the breakage of the recording head and the useless printing can be avoided, hence improving the reliability of the apparatus significantly.

The present invention produces an excellent effect on a recording apparatus using an ink jet recording method, particularly the one in which the flying droplets are formed by utilizing thermal energy for recording.

Regarding the typical structure and operational principle of such a method, it is preferable to adopt those which can be implemented using the fundamental principle disclosed in the specifications of U.S. Pat. Nos. 4,723,129 and 4,740,796. This method is applicable to the so-called on-demand type recording system and a continuous type recording system as well. Particularly, however, it is suitable for the on-demand type because the principle is such that at least one driving signal, which provides a rapid temperature rise beyond a departure from nucleation boiling point in response to recording information, is applicable to an electrothermal transducer disposed on a liquid (ink) retaining sheet or liquid passage whereby to cause the electrothermal transducer to generate thermal energy to produce film boiling on the thermoactive portion of the recording head; thus effectively leading to the resultant formation of a bubble in the recording liquid (ink) one to one for each of the driving signals. By the development and contraction of the bubble, the liquid (ink) is discharged through a discharging port to produce at least one droplet. The driving signal is more preferably in the form of pulses because the development and contraction of the bubble can be effectuated instantaneously, and, therefore, the liquid (ink) is discharged with quick response.

The driving signal in the form of pulses is preferably such as disclosed in the specifications of U.S. Pat. Nos. 4,463,359 and 4,345,262. In this respect, the temperature increasing rate of the heating surface is preferably such as disclosed in the specification of U.S. Pat. No. 4,313,124 for an excellent recording in a better condition.

The structure of the recording head may be as shown in each of the above-mentioned the specifications wherein the structure is arranged to combine the discharging ports, liquid passages, and the electrothermal transducers as disclosed in the abovementioned patents (linear type liquid passage or right angle liquid passage). Besides, the structure such as disclosed in the specifications of U.S. Pat. Nos. 4,558,333 and 4,459,600 wherein the thermal activation portions are arranged in a curved area is also included in the present invention.

In addition, the present invention is effectively applicable to the structure disclosed in Japanese patent Laid-Open Application No. 59-123670 wherein a common slit is used as the discharging ports for plural electrothermal transducers, and to the structure disclosed in Japanese patent Laid-Open Application No. 59-138461 wherein an aperture for absorbing pressure wave of the thermal energy is formed corresponding to the discharging ports.

Furthermore, as the recording head for which the present invention is effectively utilized, there is a recording head of a full-line type having a length corresponding to the maximum width of a recording medium, which is recordable by a recording apparatus. This full-line head may be the one structured by combining a plurality of the recording heads disclosed in the above-mentioned specifications or a single full-line recording head which is integrally formed. In either case, the present invention is able to demonstrate the above-mentioned effects more efficiently.

In addition, the present invention is effectively applicable to a replaceable chip type recording head which is electrically connected to the main apparatus and for which the ink is supplied when it is mounted in the main assembly; or to a cartridge type recording head having an ink tank integrally provided for the head itself.

Also, it is preferable to additionally provide the recording head recovery means and preliminarily auxiliary means as constituents of the recording apparatus according to the present invention because these additional means will contribute to enabling the effectiveness of the present invention to be more stabilized. To name them specifically, such constituents are capping means for the recording head, cleaning means, compression or suction means, preliminary heating means such as electrothermal transducers or heating elements other than such transducers or the combination of those types of elements. It is also contributable to executing a stabilized recording that the preliminary discharge mode is adopted aside from the regular discharging for recording.

Further, as the recording mode of the apparatus, the present invention is extremely effective in applying it not only to a recording mode in which only a main color such as black or the like is used, but also to an apparatus having at least one of a multi-color mode with ink of different colors, or a full-color mode using the mixture of the colors, irrespective of whether the recording heads are integrally structured or it is structured by a combination of plural recording heads.

Now, in the embodiments according to the present invention set forth above, while the ink has been described as liquid, it may be an ink material which is solidified below the room temperature but liquefied at the room temperature. Since the ink is controlled within the temperature not lower than 30° C. and not higher than 70° C. to stabilize its viscosity for the provision of the stable discharge in general, the ink may be such as to be liquefied when the applicable recording signals are given.

In addition, while positively preventing the temperature rise due to the thermal energy by the use of such energy as an energy consumed for changing states of ink from solid to liquid, or using the ink which will be solidified when left intact for the purpose of preventing the ink from being evaporated, it may be possible to adopt for the present invention the use of an ink having a nature of being liquefied only by the application of thermal energy, such as an ink capable of being discharged as ink liquid by enabling itself to be liquefied anyway when the thermal energy is given in accordance with recording signals, and an ink which will have already begun solidifying itself by the time it reaches a recording medium. In such a case, it may be possible to retain the ink in the form of liquid or solid in the recesses or through holes of a porous sheet such as disclosed in Japanese patent Laid-Open Application No. 54-56847 or 60-71260 in order to enable the ink to face the electrothermal transducers. In the present invention, the most effective method for the various kinds of ink mentioned above is the one capable of implementing the film boiling method as described above.

Further, as the mode of the recording apparatus according to the present invention, it may be possible to adopt a copying apparatus combined with a reader in addition to the image output terminal which is integrally or independently provided for a word processor, computer, or other information processing 46 apparatus, and furthermore, it may be possible to adopt a mode of a facsimile apparatus having transmission and reception functions.

As described above, according to the present embodiment, when means for attaching or detaching a cartridge is operated, the operation of carrier driving means is controlled to suspend the movement of the carrier and fix it. Therefore, the carrier is not shiftable without the provision of any particular mechanism to suspend the movement of the carrier, hence making it possible to materialize the miniaturization and low cost of the apparatus.

According to the present embodiment, the ink tank can be detached from the recording apparatus without any particular operation for the replacement of ink tanks. Also, at that time, any malfunction can be prevented from taking place with respect to the recording head by arranging a cover for the lever which is provided for detaching recording head.

Also, according to the present embodiment, the leading end of the recording material is conveyed to the position of the outlet sensor for detecting recording material when feeding the recording material, and then, by the upper margin command included in recording signals, the recording material is conveyed accordingly. Therefore, even when the head marginal position is set at the very top of the leading end of the recording material, throughput is not lowered in an actual use of the apparatus.

Also, according to the present embodiment, backward feed preventive means is provided for the movable lever and others so as not to allow the recording material which has once been exhausted to be fed backward. As a result, there is no need for making the height of the exhaust position great as in the conventional apparatus, hence making it possible to implement the miniaturization of the apparatus.

What is claimed is:

1. A recording apparatus for recording with a recording head moving along a recording medium, said recording apparatus comprising:

a carrier for moving said recording head along the recording medium;

a guide shaft member having on a periphery thereof a helical groove for guiding said carrier along the recording medium;

a sliding member provided on said carrier to engage with said helical groove to slide;

a motor for rotating said guide shaft member to move said carrier along the recording medium; and carrier movement limiting means for inhibiting movement of said carrier by maintaining said motor in a condition excited at a predetermined phase, wherein a force on said guide shaft member applied by said motor when maintained by said limiting means in the condition excited at the predetermined phase is less than an opposite force applied by said sliding member to said guide shaft member due to an external force applied to said carrier sufficient to move said sliding member from said helical groove.

2. An apparatus according to claim 1, further comprising a recording medium detecting portion provided downstream in a conveyance direction of the recording medium of a recording area where the recording head records on the recording medium and recording medium conveyance control means for controlling to convey a leading recording position of the recording medium to the recording area after the recording medium is conveyed until said recording medium detecting portion detects a leading end of the recording medium.

3. An apparatus according to claim 1, further comprising a reverse conveyance preventing mechanism for preventing the recording medium from being conveyed backwards in said recording apparatus after conveyance of the recording medium has been completed to a recording medium holding portion downstream in a conveyance direction of the recording medium of said recording area where the recording head records on the recording medium.

4. An apparatus according to claim 3, wherein said reverse conveyance preventing mechanism is provided in a conveyance route between the recording area and said recording medium holding portion and causes the recording medium to be conveyed only in a direction toward said recording medium holding portion.

5. An apparatus according to claim 3, wherein said sliding member is supported by an elastic member and pressed to said helical groove.

6. An apparatus according to claim 1, wherein said carrier comprises a mounting surface for mounting an ink jet recording head having an ink discharge port as said recording head and an ink tank for storing ink to be supplied to said recording head.

7. An apparatus according to claim 6, wherein said ink tank is removable from said recording head in a state that said ink tank is mounted on the mounting surface of said carrier.

8. An apparatus according to claim 6, wherein said recording head comprises an electrothermal converting element for generating thermal energy for discharging ink.

9. An apparatus according to claim 1, further comprising:

an elastic member for pressing said sliding member to said helical groove in a pressing direction; and a stopper member contactable with said elastic member in response to displacement of said elastic member in a direction opposite to the pressing direction, said stopper member preventing said sliding member from being removed from said helical groove by contacting said elastic member.

10. An apparatus according to claim 1, wherein the force applied by the motor is controlled by said limiting means controlling one of an excited current and an excited voltage for said motor.

11. A recording apparatus for recording with a recording head moving along a recording medium, said recording apparatus comprising:

a carrier for moving said recording head along the recording medium;

a motor for generating a drive force for moving said carrier along the recording medium; and carrier movement limiting means for controlling drive of said motor to perform a motor control for maintaining said carrier stopped in a stopped condition, wherein said motor generates a force of a predetermined magnitude in the stopped condition, the predetermined magnitude being less than a magnitude of a force due to application of an external force to said carrier sufficient to forcibly release the stopped condition.

12. An apparatus according to claim 11, wherein and said carrier comprises a sliding member engageable in a helical groove of a guide shaft member rotatable by said motor, and said sliding member is supported by an elastic member and pressed to said helical groove.

13. An apparatus according to claim 12, further comprising:

an elastic member for pressing said sliding member to said helical groove in a pressing direction; and a stopper member contactable with said elastic member in response to displacement of said elastic member in a direction opposite to the pressing direction, said stopper member preventing said sliding member from being removed from said helical groove by contacting said elastic member.

14. An apparatus according to claim 11, wherein said carrier comprises a mounting surface for mounting an ink jet recording head having an ink discharge port as said recording head and an ink tank for storing ink to be supplied to said recording head.

15. An apparatus according to claim 14, wherein said ink tank is removable from said recording head in a state that said ink tank is mounted on the mounting surface of said carrier.

16. An apparatus according to claim 14, wherein said recording head comprises an electrothermal converting element for generating thermal energy for discharging ink.

17. An apparatus according to claim 11, wherein said limiting means controls the drive of said motor to maintain said carrier stopped in the stopped condition by controlling one of an excited current and an excited voltage for said motor.

18. A recording apparatus for recording with a recording head moving along a recording medium, said recording apparatus comprising:

a carrier for moving said recording head along the recording medium;

a guide shaft member having on a periphery thereof a helical groove for guiding said carrier along the recording medium;

a sliding member provided on said carrier to engage with said helical groove to slide;

a motor for rotating said guide shaft member to move said carrier along the recording medium; and carrier movement limiting means for inhibiting movement of said carrier by maintaining said motor in a condition excited at a predetermined phase, wherein a force on said guide shaft member applied by said motor when maintained by said limiting means in the condition excited at the predetermined phase is less than an external force applied to an engaging portion between said helical groove and said sliding member and having a magnitude and an effecting direction sufficient to remove said sliding member from said helical groove.

19. An apparatus according to claim 18, further comprising a recording medium detecting portion provided downstream in a conveyance direction of the recording medium of a recording area where the recording head records on the recording medium and recording medium conveyance control means for controlling to convey a leading recording position of the recording medium to the recording area after the recording medium is conveyed until said recording medium detecting portion detects a leading end of the recording medium.

20. An apparatus according to claim 18, further comprising a reverse conveyance preventing mechanism for preventing the recording medium from being conveyed backwards in said recording apparatus after conveyance of the recording medium has been completed to a recording medium holding portion downstream in a conveyance direction of the recording medium of a recording area where the recording head records on the recording medium.

21. An apparatus according to claim 20, wherein said reverse conveyance preventing mechanism is provided in a conveyance route between the recording area and said recording medium holding portion and causes the recording medium to be conveyed only in a direction toward said recording medium holding portion.

22. An apparatus according to claim 18, wherein said sliding member is supported by an elastic member and pressed to said helical groove.

23. An apparatus according to claim 18, wherein said carrier comprises a mounting surface for mounting an ink jet recording head having an ink discharge port as said recording head and an ink tank for storing ink to be supplied to said recording head.

24. An apparatus according to claim 23, wherein said ink tank is removable from said recording head in a state that said ink tank is mounted on the mounting surface of said carrier.

25. An apparatus according to claim 23, wherein said recording head comprises an electrothermal converting element for generating thermal energy for discharging ink.

26. An apparatus according to claim 18, further comprising:

an elastic member for pressing said sliding member to said helical groove in a pressing direction; and a stopper member contactable with said elastic member in response to displacement of said elastic member in a direction opposite to the pressing direction, said stopper member preventing said sliding member from being removed from said helical groove by contacting said elastic member.

27. An apparatus according to claim 18, wherein the force applied by the motor is controlled by said limiting means controlling one of an excited current and an excited voltage for said motor.

28. A recording apparatus for recording on a recording medium by use of recording means traveling along the recording medium, said apparatus comprising:

a carrier for carrying the recording means in a moving area along the recording medium, said carrier holding said recording means detachably for replacement;

a carrier driving mechanism for driving said carrier along the recording medium;

prohibiting means for prohibiting movement of said carrier at a predetermined recording means exchanging position in the moving area of said carrier; and releasing means for releasing the prohibition of the movement of said carrier by said prohibiting means when an external force larger than a predetermined magnitude is applied to said carrier upon an exchange at the recording means exchanging position.

29. A recording apparatus according to claim 28, wherein said carrier driving mechanism comprises a stepping motor, and said prohibiting means prohibits the movement of said carrier by holding said motor in a state of excitation at an arbitrary phase.

30. A recording apparatus according to claim 28, wherein said carrier driving mechanism comprises a guide rail having a threaded groove to guide said carrier and a pin member provided for said carrier to be coupled to said threaded groove, and the coupling between said threaded groove and said pin member is not released by the external force exceeding the predetermined amplitude.

31. A recording apparatus according to claim 28, wherein attachment and detachment of the recording means to and from said carrier is prohibited when said carrier is positioned at a home position of the recording means.

32. A recording apparatus according to claim 28, wherein the recording means comprises an ink tank said recording head and said ink tank are separable from one for storing ink.

33. A recording apparatus according to claim 28, wherein the recording means comprises an ink jet recording head for discharging ink through an ink discharge port.

34. A recording apparatus according to claim 33, wherein said ink jet recording head includes electrothermal transducers generating thermal energy utilized for discharging ink.

35. A recording apparatus according to claim 33, further comprises a capping member for capping said ink discharge ports in a position where attachment and detachment of the recording means to and from said carrier are prohibited.

* * * * *

UNITED STATES PATENT AND TRADEMARK OFFICE

CERTIFICATE OF CORRECTION

PATENT NO. : 6,050,673
DATED : April 18, 2000
INVENTOR(S) : Wada, et al.

It is certified that error appears in the above-identified patent and that said Letters Patent is hereby corrected as shown below:

Foreign Application Priority Data:
Line 4, "5-066349" should read -- 5-06349 --.

References Cited:
FOREIGN PATENT DOCUMENTS, "62090280" should read -- 62-90280 --, and"4187477" should read -- 4-187477 --.

Column 1:
Line 23, "apparat us," should read -- apparatus, --.

Column 4:
Line 22, "In specific" should read -- Specifically, --.

Column 5:
Line 11, "a" should read -- an --.

Column 8:
Line 31, "device" should read -- devices --.
Line 61, "soft" should read -- soft– --.

Column 11:
Line 63, "errorneously" should read -- erroneously --.

Column 12:
Line 20, "or the like" (second occurrence) should be deleted.
Line 39, "motor" should read -- pulse motor --.

Column 13:
Line 33, "L2-the" should read -- L2 - the --.
Line 51, "1117" (second occurrence) should be deleted.

UNITED STATES PATENT AND TRADEMARK OFFICE

CERTIFICATE OF CORRECTION

PATENT NO. : 6,050,673
DATED : April 18, 2000
INVENTOR(S) : Wada, et al.

It is certified that error appears in the above-identified patent and that said Letters Patent is hereby corrected as shown below:

Column 14:
Line 12, "(counter-clock wise" should read -- (counterclockwise --
Line 13, "good" should read -- strong --.
Line 34, "counter-clock wise" should read -- counterclockwise --.

Column 16:
Line 16, "the specifications" should read -- specifications --.

Column 17:
Line 38, "46" should be deleted.

Column 19:
Line 28, "and" should be deleted.

Column 22:
Line 10, "said recording" should be deleted.
Line 11, "head and said ink tank are separable from one" should be deleted.
Line 20, "comprises" should read -- comprising --.

Signed and Sealed this

Twenty-first Day of August, 2001

*Attest:*

Nicholas P. Godici

NICHOLAS P. GODICI
*Acting Director of the United States Patent and Trademark Office*

*Attesting Officer*